US006079231A

United States Patent [19]

Shima

[11] Patent Number: 6,079,231

[45] Date of Patent: Jun. 27, 2000

[54] STITCH LOOP HOLDING APPARATUS FOR A FLAT KNITTING MACHINE

[75] Inventor: Masahiro Shima, Wakayama, Japan

[73] Assignee: Shima Seiki Mfg., Ltd., Wakayama, Japan

[21] Appl. No.: 09/311,881

[22] Filed: May 14, 1999

[30] Foreign Application Priority Data

May 15, 1998 [JP] Japan ..... 10-132922

[51] Int. Cl.[7] ..... D04B 7/04

[52] U.S. Cl. ..... 66/64; 66/148

[58] Field of Search ..... 66/60 R, 62, 64, 66/66, 75.1, 78, 95, 96 R, 148, 147

[56] References Cited

U.S. PATENT DOCUMENTS 4,474,037 10/1984 Kühnert .
5,398,527 3/1995 Hirai et al. ..... 66/148
5,423,204 6/1995 Shima et al. ..... 66/109
5,469,717 11/1995 Shibuta et al. ..... 66/69

FOREIGN PATENT DOCUMENTS 0 881 314 A2 12/1998 European Pat. Off. .
0 890 667 A2 1/1999 European Pat. Off. .

*Primary Examiner*—Danny Worrell
*Attorney, Agent, or Firm*—Armstrong, Westerman, Hattori, McLeland and Naughton

[57] ABSTRACT

A stitch loop holding apparatus for a flat knitting machine using compound needles wherein in addition to needle operation means for knitting stitch loops, in order to hold a knitted stitch loop to the tongue of a slider of another needle without forming a double stitch, needle body and slider operating holding cams for advancing the hook and the tongue of the needle into a stitch loop to be held and holding the stitch loop at the tongue of the slider and a slider butt path for holding the tongue at an advanced position so that the held loop may not escape from the tongue, are provided on a carriage.

4 Claims, 16 Drawing Sheets

5B
5C
5D
5E
A
B
H
11
13
14
15
16a
16b
18
20
30
31
38
39
51
52
54
60H
61
63
64
65
76
4fa
24
36
37
27
FB
NL1

6E
6D
6C
6B
13
77
78
74
74a
73a
73
72a
72
38
30
31
39
A
H
B
11
24
4fb
15
27
37
NL1
NL2

KNITTING OF FRONT BODY

HOLDING OF PURL LOOPS OF FRONT BODY (BD→FD)

TRANSFER OF PURL LOOPS OF BACK BODY (BD→FU)

KNITTING OF BACK BODY

HOLDING OF PURL LOOPS OF BACK BODY (FU→BD)

TRANSFER OF PURL LOOPS OF FRONT BODY (FD→BU)

STITCH LOOP HOLDING APPARATUS FOR A FLAT KNITTING MACHINE

BACKGROUND OF THE INVENTION a. Field of the Invention

This invention relates to a flat knitting machine provided with compound needles which makes it possible, when it becomes necessary to produce an empty needle in needles being used for knitting while knitting is performed using the flat knitting machine, to make an empty needle by holding a loop held on the needle to another needle, a transfer jack or some other member.

b. Description of Related Art

A usual flat knitting machine is formed as a so-called two-bed flat knitting machine wherein a pair of needle beds on each of which a large number of needles are provided in a row are disposed forwardly and rearwardly on the opposite sides of a needle bed gap. A flat knitting machine of the type mentioned is constructed such that the needles on the needle beds are used to knit stitch loops and the stitch loops formed on each of the needle beds can be transferred to the opposing needles of the other needle bed, and can knit various knit fabrics by combinations of stitch formation and transfer of loops.

As needles for use with a flat knitting machine, latch needles and compound needles are available. It is known that employment of compound needles allows a knitting machine to be formed with a reduced size since the back and forth stroke of a needle can be reduced to approximately one half when compared with conventional latch needles because the slider and the needle body of a compound needle are moved relative to each other to open and close the hook, and this results in augmentation of the productivity. Various types of compound needles have been developed till now.

Upon knitting of a knit fabric, for example, if only the needles on the front needle bed are used for knitting, then a knit fabric of a plain stitch structure (knit stitches) is knitted, but if a yarn is supplied in a zigzag pattern to the needles of the front and back needle beds, then a knit fabric of a rib (rib) stitch structure is knitted.

On the other hand, if circulating knitting is performed such that a yarn is first supplied to the needles of the front needle bed and then supplied to the needles of the back needle bed continuously, then a tubular knit fabric composed of a front side knit fabric and a back side knit fabric are joined to each other at the opposite ends hereof is knitted.

In order to perform knitting with knit stitches and purl stitches included in a mixed condition in the same wale or to perform such knitting such that a stitch loop is moved and overlapped with an adjacent stitch loop, an empty needle on the opposing needle bed is used. For example, in order to knit a links-and-links pattern as a pattern which includes knit stitches and purl stitches in a mixed condition, stitch loops are first formed on the front needle bed and then the stitch needles are transferred to the needles of the opposing back needle bed and then stitch loops of the following course are formed on the back needle bed, and in the succeeding knitting, stitch loops are successively transferred back and forth alternately between the two beds to knit the succeeding sources. On the other hand, in order to knit a texture pattern or perform full-fashioned knitting, stitch loops are first transferred to empty needles of the other needle bed, and then the needle beds are racked relative each other, whereafter the transferred stitch loops are transferred to adjacent needles to the needles of the original needle bed so that they are overlapped with stitch loops of the adjacent needles.

In order to knit a knit fabric of a plain stitch, a wide rib stitch or the like, the opposing needles should be used because they are empty needles. However, in knitting of a 1×1 rib stitch fabric or a tubular knit fabric which is knitted using all of the needles of the front-t and back needle beds, it is impossible to such knitting as described above because empty needles to which stitch loops should be transferred cannot be assured. In this instance, such a countermeasure must be taken to use a flat knitting machine of the type which includes, in addition to a pair of front and back needle beds, an auxiliary bed (transfer jack bed) which accommodates transfer jacks as knitting members for exclusive use for loop transfer or a so-called four-bed flat knitting machine which includes another pair of needle beds provided above front and rear needle beds to obtain empty needles.

In this manner, conventionally it is an essential requirement that, in order to transfer stitch loops between needle beds, empty needles be present on the other needle bed, and, where a knit fabric for which empty needles cannot be assured is knitted, the requirement has been, as a fixed idea, a significant restriction to development of the variety of knitting of knit fabrics. This follows that, when another stitch loop is transferred to a needle on which a stitch loop is held, the two stitch loops form a double stitch and cannot be separated from each other any more, and consequently, also such a transfer jack bed or a four-bed flat knitting machine as described above is subject to the common problem to that of a two-bed flat knitting machine.

BRIEF SUMMARY OF THE INVENTION

Taking the foregoing into consideration, it is an object of the present invention to obtain a loop holding apparatus by which, in such an instance that it becomes necessary during knitting of a knit fabric to knit another knit fabric using those needles by which the knit fabric is being knitted, loops held on the needles can be caused to be held on loop holding members such as other needles such that loops already held on the loop holding members are isolated from the loops newly left on the loop holding members, and when the necessity disappears, the thus left loops can be returned to the original needles.

In the present specification, to "hold" a stitch loop does not signify ordinary "transfer" of merely transferring a stitch loop into the hook of another needle (in this instance, if the receiving side needle has a stitch loop held thereon, then overlapping stitches (double stitch) are formed in the hook of the needle), but signifies that the receiving side needle holds a stitch loop held already by the needle itself and the newly received stitch loop in a mutually separate state thereon. In other words, in the apparatus of the present invention, to "hold" a stitch loop signifies that a stitch loop held already by a needle itself is held in the hook of a needle body of the needle while a stitch loop received newly is held on the tongue of a slider. In the following, the terms "transfer" and "hold" are hereinafter used as terms signifying the contents described above.

According to the present invention, a stitch loop holding apparatus for a flat knitting machine wherein compound needles (hereinafter referred to as needles) each including a needle body and a slider constructed for movement relative to each other are provided in rows on at least one pair of front and back needle beds disposed in an opposing relationship to each other and a tongue of the slider of each of the needles is formed as a layered body of two thin resilient plate-like members and is operable to open and close a hook opening of a hook provided at an end of the needle body and advance farther than the hook, and then, when the tongue advances farther than the hook, an end of the tongue can be laterally opened by the hook so that the tongue can be protruded to a needle bed gap in a condition wherein a stitch loop held on the needle itself is placed on the tongue, the needle body and the slider being controllable to be advanced and retracted by needle operation means including needle body operation means and slider operation means provided on a carriage, is constructed such that it comprises, in addition to the needle operation means for knitting stitch loops, in order to hold a knitted stitch loop to the tongue of the slider of another needle without forming a double stitch, needle body and slider operating holding cams for advancing the hook and the tongue of the needle into a stitch loop to be left and holding the stitch loop at the tongue of the slider and a slider butt path for holding the tongue at an advanced position so that the left loop may not escape from the tongue, are provided.

Further, a stitch loop holding apparatus for a flat knitting machine is constructed such that it comprises, in addition to the needle operation means for knitting stitch loops, in order to hold a knitted stitch loop to the tongue of the slider of another needle without forming a double stitch, holding cams for operating the needle body and the slider to insert the hook and the tongue of the needle into a stitch loop to be held and holding the stitch loop at the tongue of the slider is provided on a carriage separately and in a displaced phase from the needle operation means for knitting stitch loops, and a slider butt path for holding the tongue at an advanced position so that the held loop may not escape from the tongue.

A stitch loop holding apparatus for a flat knitting machine of the present invention is still further constructed such that the needle body operation means includes a raising cam including a pair of mountains disposed in a juxtaposed relationship on the left and right and each including a peripheral edge serving as a pair of butt raising faces, a low top portion of the tuck height and a high top portion higher than the low top portion, and a needle transfer cam provided between the pair of mountains, the raising cam having a pair of crossing paths provided at base portions of the pair of left and right mountains thereof such that the crossing paths are communicated at central portions thereof with butt guide grooves of the peripheries of the left and right, high and low mountains, a pair of knitting cams on the opposite sides of the raising cam, and a guard cam above the raising cam, and the slider operation means includes a delivery slider advancing cam having a delivery slider raising groove formed therein and a reception slider holding cam which forms a receiver slider raising groove, both provided sidewardly of a slider transfer cam provided on the same center line as that of the raising cam, the slider cam having a slider butt path provided therein for holding the tongue at an advanced position so that the loop held on the tongue may not escape from the tongue.

DETAILED DESCRIPTION OF THE INVENTION

Figure 1:
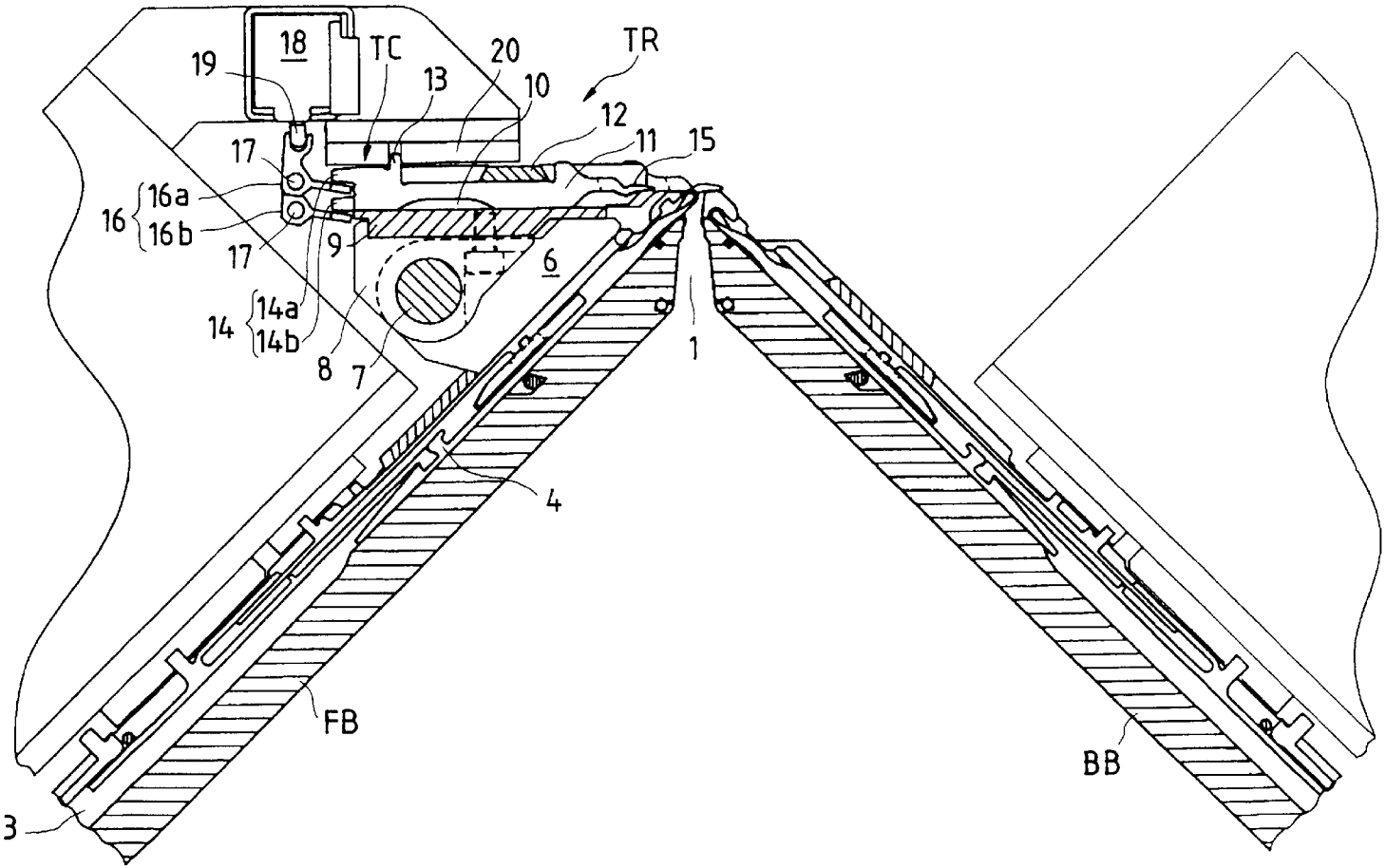
FIG. 1 is a sectional view of a head portion of a needle bed on which transfer jacks are provided.

Embodiments of an apparatus of the present invention are described below. The apparatus of the present invention performs operation of holding, when it becomes necessary to knit, with needles with which a knit fabric is being knitted, a second knit fabric different from the first knit fabric being knitted, loops of the first knit fabric held on the needles once to loop holding members, transferring, after the second knit fabric with those needles which have thus been rendered empty is knitted, loops of the second knit fabric to other needles or elements, and then returning the held loops to the emptied needles, other needles or loop holding members. For the loop holding members which receive the loops to be held, transfer jacks, compound needles each having a tongue for receiving a stitch loop at an end thereof or some other members are used.

An apparatus wherein transfer jacks are used as the loop holding members is described as the first embodiment. The first embodiment includes a transfer member TR, which includes transfer jacks 11, above at least one of a pair of front bed FB and back bed BB provided forwardly and backwardly in a mountain-like geometry with head portions thereof opposed to each other at a needle bed gap 1 (in the example shown, above the front bed FB).

The front bed FB and the back bed BB are known ones, and a compound needle 4 is inserted in each of needle tricks 3 of them. Portions in the proximity of the top portions of some or all of needle plates (of the front bed FB) by which the needle tricks 3 are defined extend upwardly, and a shaft 7 extends through the extension 6 and a transfer jack bed 9 is provided on a block 8 supported on the shaft 7. Transfer jacks 11 are inserted and supported in tricks 10 provided in a juxtaposed relationship on the transfer jack bed 9. The transfer jacks 11 are held by a metal band 12 from being removed from the tricks 10. Each of the transfer jacks 11 has a transfer jack butt 13 provided at an upper edge thereof and has a projection 14 provided at a tail portion thereof. Two kinds of projections 14 are prepared including a projection 14*a* which is provided at a position near to the top edge and another projection 14*b* provided near to the bottom edge.

A holding piece 15 for holding a loop of a knit fabric which will be hereinafter described is provided at a top portion of each of the transfer jacks 11. Rocking cams 16 for contacting with the projections 14*a*, 14*b* to advance the transfer jacks 11 are provided in an opposing relationship to the projections 14*a*, 14*b*. The rocking cams 16 includes rocking cams 16*a*, 16*b* which oppose to the projections 14*a*, 14*b*, respectively, and are supported for rocking motion on shafts 17, 17.

Figures 5A, 5B, 5C, 5D, 5E:
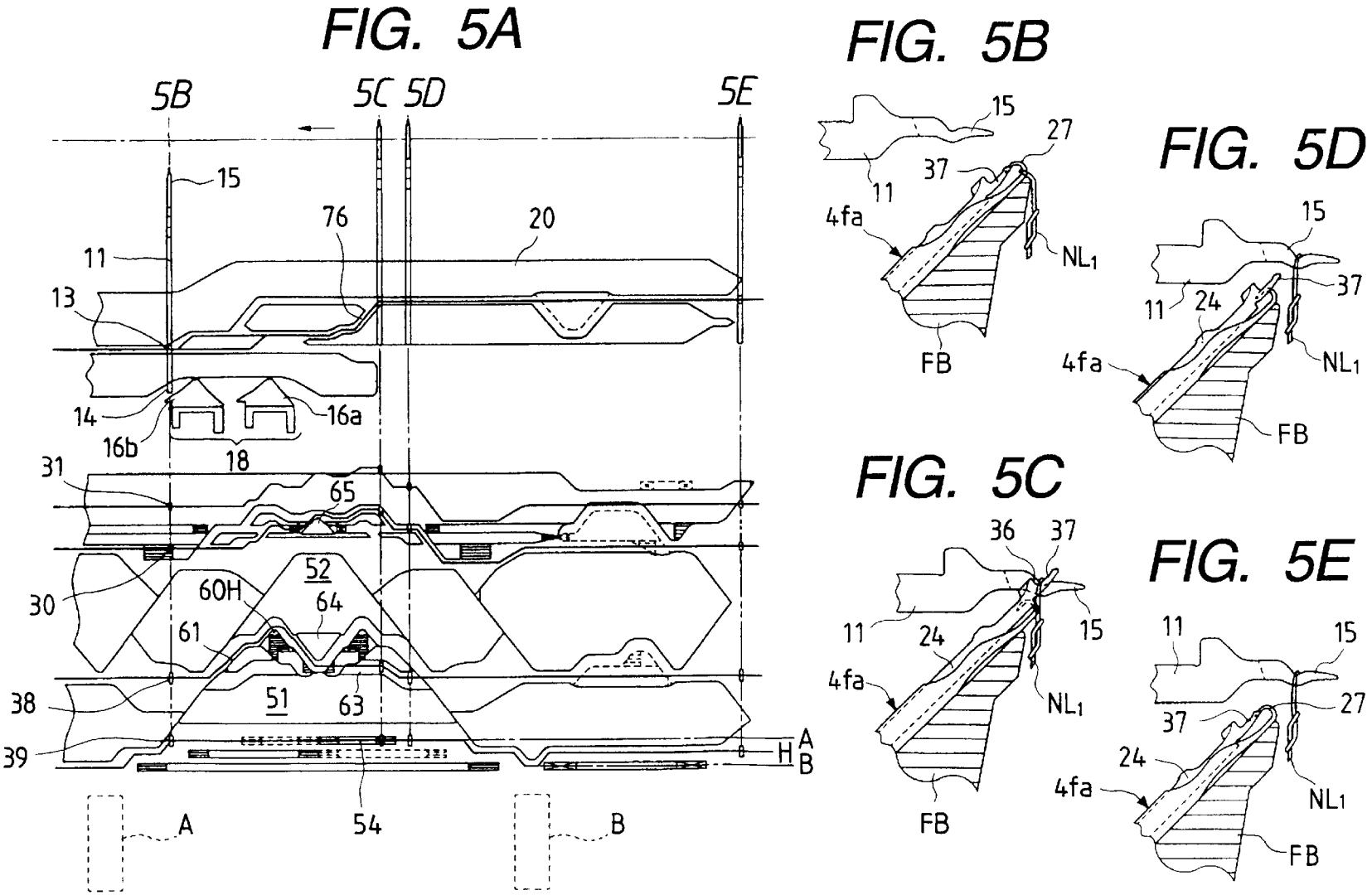
FIG. 5A shows 5B to 5E positions of a needle on a carriage and FIGS. 5B to 5E show relative positions of the needle and a transfer jack on the needle bed corresponding to the 5B to 5E positions.
Figures 6A, 6B, 6C, 6D, 6E:
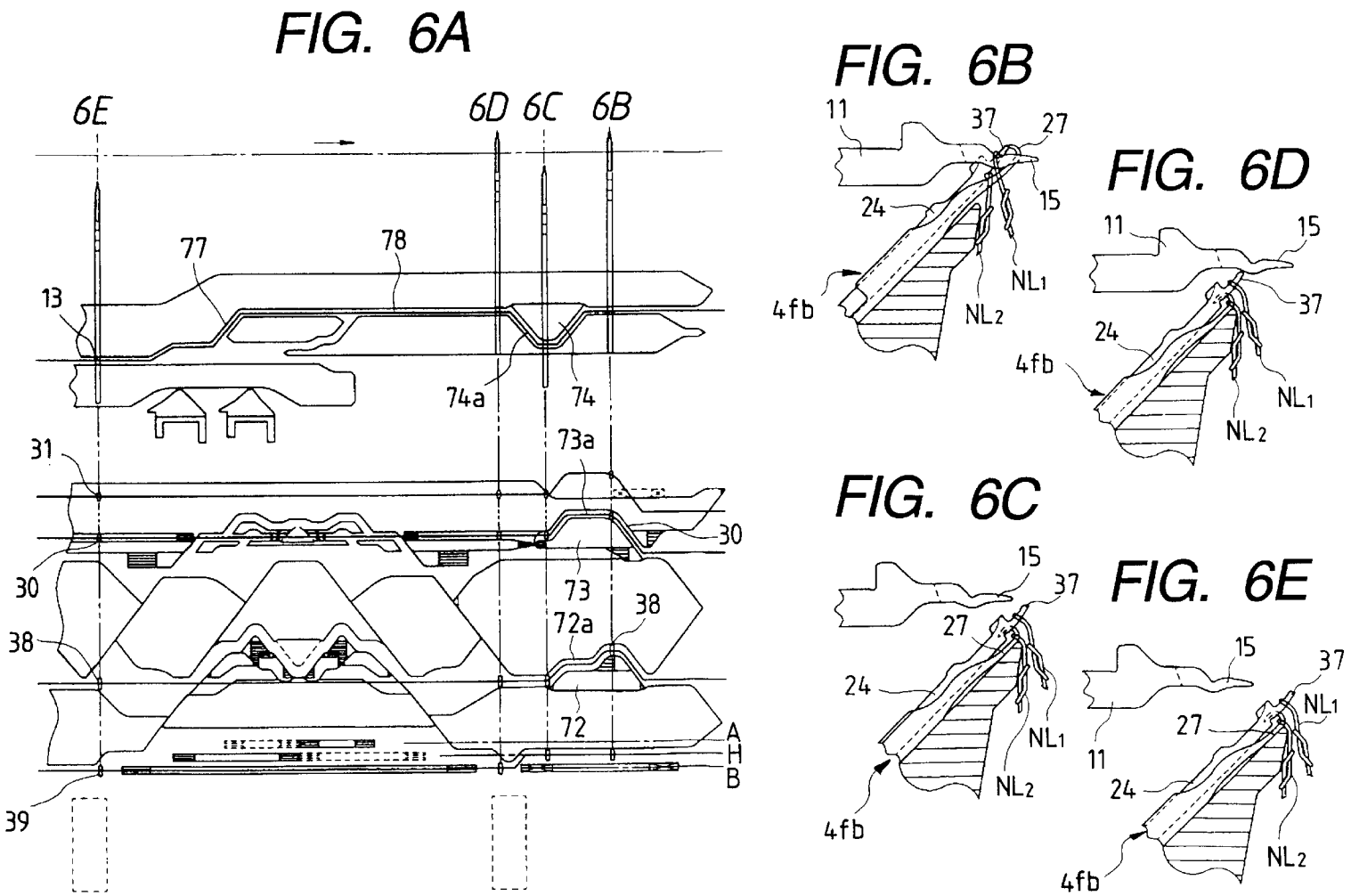
FIG. 6A shows 6B to 6E positions of the needle on the carriage and FIGS. 6B to 6E show relative positions of the needle and the transfer jack on the needle bed corresponding to the 6B to 6E positions.

Each of the rocking cams 16*a*, 16*b* has, as shown in FIG. 1 in which a side elevational view thereof is shown, an L-shape centered at the location of a shaft 17 and has an upper end portion engaged with a rocking arm 19 of a transfer jack selection member (solenoid) 18. Two kinds of transfer jack selection members 18 are provided for the rocking cams 16*a*, 16*b*. The rocking cams 16*a*, 16*b* have a triangular end portion as shown in FIG. 5.

Each of the transfer jack butts 13 is fitted for sliding movement in a guide groove for a transfer jack guide cam 20 of a transfer jack operating cam TC which will be hereinafter described.

Figure 2:
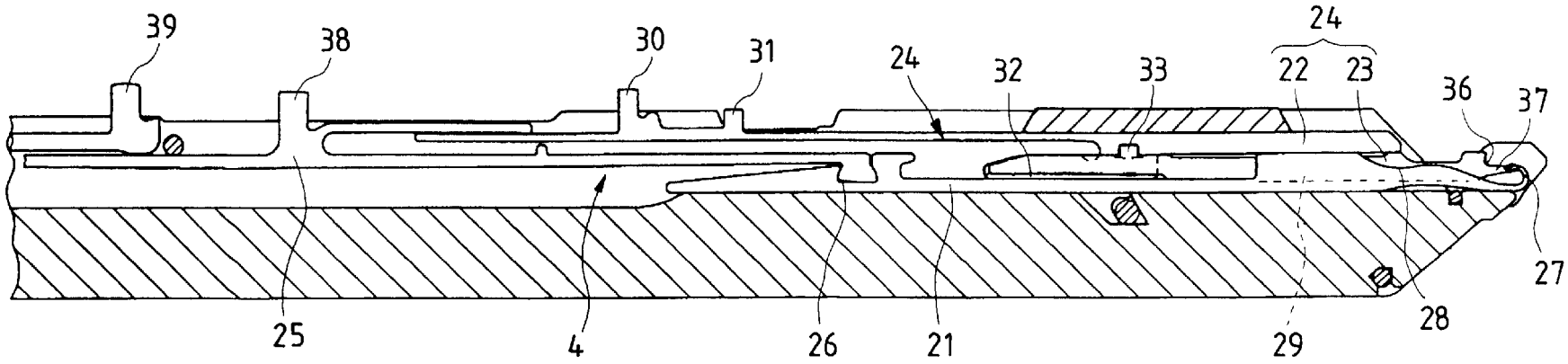
FIG. 2 is a sectional view of the head portion of the needle bed in which composite needles are inserted.
Figures 3A, 3B:
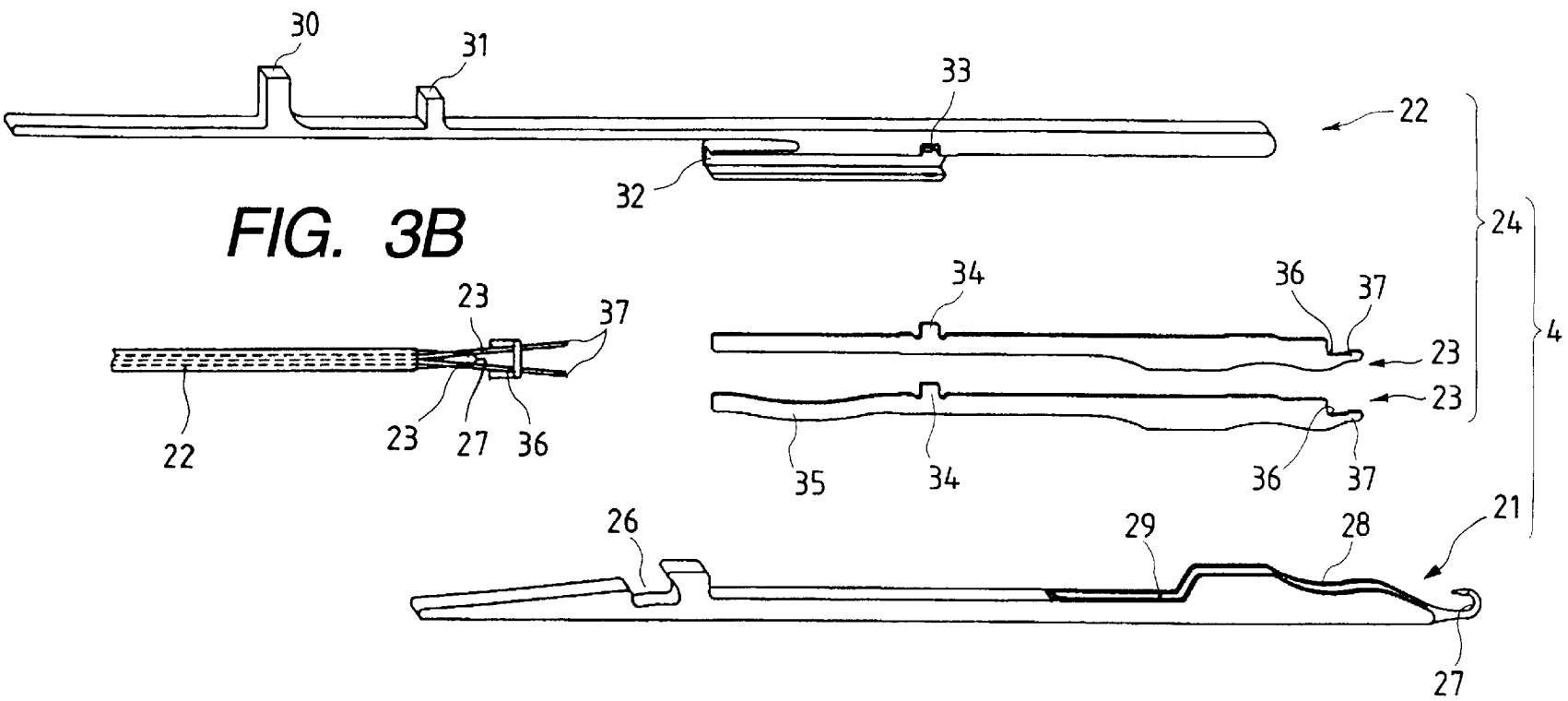
FIG. 3A is a perspective view of a compound needle in a disassembled condition and FIG. 3B is a plan view of the compound needle with a hook open.

A compound needle 4 described hereinabove is shown in FIGS. 2, 3A and 3B. The compound needle 4 includes a needle body 21, and a slider 24 including a slider base member 22 and two resilient plates 23, 23. The needle body 21 has a recess 26 in the proximity of a tail portion thereof for engaging with a top portion of a needle jack 25 (shown in FIG. 2), and a slit 29 is formed at a portion of the needle body 21 from a throat portion 28 at a base portion of the hook 27 at a top portion of the needle body 21 to a middle portion of the needle body. The slider base member 22 has an upwardly extending slider butt 30 and auxiliary butt 31 formed in the proximity of the tail portion thereof, and a resilient plate retaining member 32 having a channel-like cross section is provided in the proximity of a top portion of the slider base member 22 such that it protects downwardly. The resilient plates 23, 23 have substantially same shapes as each other and each has a projection 34 at an upper portion of a middle portion thereof for engaging with the recess 33 of the slider base member 22, and the two resilient plates 23, 23 are supported on the resilient plate retaining member 32 with the projections 34 thereof fitted in the recess 33.

An L-shaped bent portion 35 is formed at a tail portion of one 23 of the two resilient plates 23, 23 so that, when the needle body 21 is inserted in a needle trick 3 (shown in FIG. 1) of a needle bed, the curved portion 35 may resiliently contact with a side wall of the needle trick to prevent the needle body 21 from being moved inadvertently.

A shoulder 36 is formed at an end of each of the resilient plates 23, 23 to define a tongue 37. The tongues 37 are inclined a little obliquely upwardly at end portions thereof to assure holding of a yarn.

The slider base member 22 is supported on the resilient plate retaining member 32 with the projection 34 of the two resilient plates 23, 23 fitted in the recess 33 and the two resilient plates 23, 23 are fitted for sliding movement in the slit 29 of the needle body 21 such that the resilient plates 23, 23 may be moved toward and away from the hook 27 of the needle body 21 by an operation of the slider butt 30. When the resilient plates 23, 23 are raised toward the hook 27 from below the hook 27, the resilient plates 23, 23 are separated from each other as shown in FIG. 3B and move upwardly on the opposite sides of the hook 27 in such a manner that the tongues 37, 37 hold the hook 27 from the opposite sides. Reference numeral 38 denotes a needle jack butt, and 39 a select jack butt.

Figure 4:
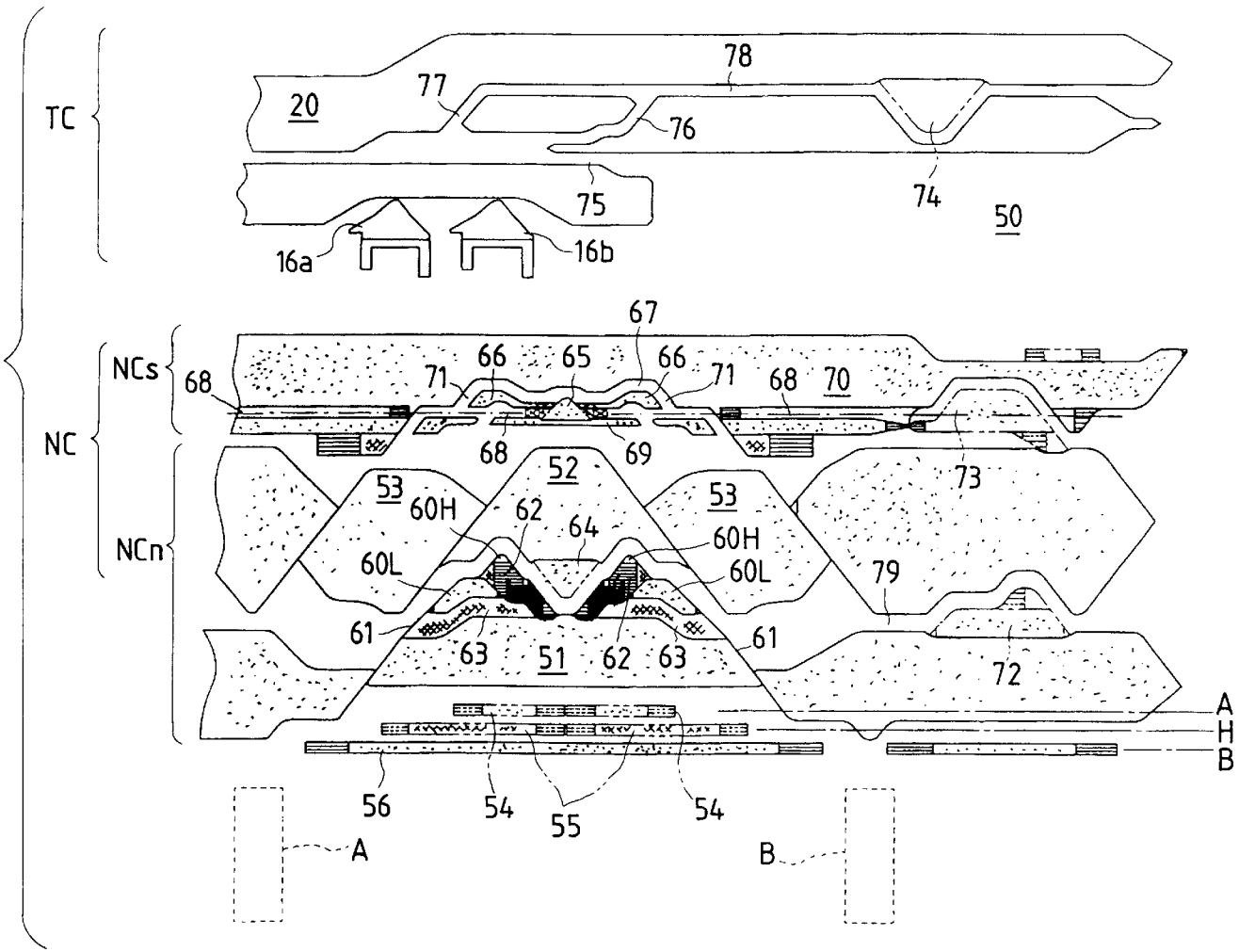
FIG. 4 shows a needle operating cam NC and a transfer jack operating cam set TC disposed on a carriage base plate in a first embodiment as viewed from below.

A cam arrangement of a carriage in the present embodiment is described below. FIG. 4 shows a needle operating cam NC and the transfer jack operating cam set TC disposed on a base plate 50 of the carriage as viewed from below.

The needle operating cam NC includes a needle body operating cam set NCn and a transfer jack operating cam set NCs. The needle body operating cam set NCn includes a raising cam 51, a guard cam 52 provided above the raising cam 51, a pair of knitting cams 53 on the opposite sides of the raising cam 51, a pair of A pressers 54 and a pair of half pressers 54 provided below the raising cam 51 and each movable to and from a projected position, and a B presser 56 fixed in a normally projected condition below the half presser 55. The heights (butt pressing amounts) of the pressers mentioned above are such that the A pressers 54 and the B presser 56 have a maximum or full height and the half pressers 54 has a half height. At a lower position on the leading side of the B presser when the carriage moves, a pair of needle selection elements A, B for selecting a passage to one of the pressers is provided.

The cams mentioned above have three different heights from the surface of the carriage base plate, and the cams having the maximum or full height are indicated by fine dots on the drawing while the cams of a half height is indicated by obliquely crossing lines and the remaining lower cams are painted up with black. Blank portions denote the base plate 50.

The raising cam 51 has a pair of left and right mountains including a pair of mountain-shaped high summit portions 60H and a pair of low summit portions 60L having a height equal to that of the shoulders of the high summit portions 60H, and outer side walls of the mountains form butt raising faces 61 and opposing inner wall faces form inclined faces 62 so that jumping over of the high summit portions 60H may be allowed. Below the two high summit portions 60H, a pair of crossing paths 63 connecting to the lowest position between the two high summit portions 60H, 60H are provided. Part of a lower portion of the guard cam 52 positioned between the two high summit portions 60H, 60H described above is provided for projecting movement as a needle transfer cam 64 of an inverted triangular shape. A pair of needle holding cams 72 are provided on needle butt paths 79 extended sidewardly from the crossing paths 63.

The transfer jack operating cam set NCs is centered commonly to the needle body operating cam set NCn and includes a guide cam 70 opposing to the summit of the guard cam 52, and a slider transfer cam 65 is provided for movement to and from a projected position at the center of the transfer jack operating cam set NCs. A pair of slider advancing cams 66, 66 are provided on the upper side of the slider transfer cam 65, and a slider butt raising path 67 is formed along upper edges of the slider advancing cams 66, 66 and a horizontal path 68 (indicated by an alternate long and short dash line in FIG. 4) is formed on the same level as the slider transfer cam 65 along lower edges of the slider advancing cams 66, 66. The horizontal path 68 extends sidewardly of the slider transfer cam 65 between a guide cam 69 and the slider advancing cams 66, 66, and a pair of slider holding cams 73 are provided on the path. The horizontal path 68 and the slider butt raising path 67 are connected to each other by a pair of connection paths 71.

The transfer jack operating cam TC includes a transfer jack guide cam 20 for guiding the transfer jacks 11 selected by the rocking cams 16 which select the transfer jacks 11 described hereinabove, and has a straightforward path 75 along which the transfer jacks 11 not selected advance straightforwardly as they are to pass the same, a branch path 76 into which the transfer jacks 11 selected are branched and advanced, a retraction path 77 along which the transfer jacks branched and advanced are returned to the original position, and an advancement path 78 along which the branched transfer jacks keep their advanced positions.

A transfer cam 74 movable to and from a projected position is provided in the advancement path 78 such that, when the transfer cam 74 is in its projected position, the transfer cam 74 retracts each transfer jack 11 at the position.

It is to be noted that, while the present specification sometimes uses, in regard to a relative movement between the carriage or any element on the carriage such as a cam or a path and any element on the needle beds, such an expression that an element on a needle bed moves with respect to an element on the carriage, naturally the element on the carriage actually moves with respect to the element on the needle bed, and the expression is used to facilitate understanding of the relative movement when reference is had to such a figure as FIG. 4 which illustrates such relative movement, as used popularly in specifications of patents relating to knitting machines. For example, the expression that a transfer jack not selected advances straightforwardly along a straightforward path (a similar context is found in the preceding paragraph) actually signifies that, while the carriage moves horizontally, the transfer jack stays at its position in the straightforward path.

In the following, a process of holding a stitch loop is described with reference to FIGS. 5 to 9. In each of those figures, loci of a selector jack butt 39, a needle jack butt 38, a slider jack butt 30, an auxiliary butt 31 and a transfer jack butt 13 on the cam plane are drawn as FIG. 5A to FIG. 9A on the left side, and raised or lowered or in other words advanced or retracted positions of a needle 4*fa* and a transfer jack 11 at different positions in the loci shown in FIG. 5A to FIG. 9A are shown together with cross sections of the front bed FB on the right side. It is to be noted that an arrow mark in A of each figure represents an advancing direction of the carriage.

In the example shown, particularly a loop NL1 of a needle 4*fa* of the front bed FB is transferred once to the holding piece 15 of the transfer jack 11 to make the needle 4*fa* empty and the loop NL1 is held to the tongue 37 of the slider of a needle 4*fb* different from the needle 4*fa* to make the needle 4*fa*, which initially had the loop NLE thereon, empty, and then the loop NL1 which has been held on the tongue 37 of the different needle 4*fb* is transferred to the holding piece 15 of the transfer jack 11, whereafter the loop NL1 is transferred from the transfer jack 11 to the first needle 4*fa* or a needle different from the needle 4*fa*.

It is assumed that the carriage advances in the leftward direction in FIGS. 5A to 5E, and the selector jack butt 39 of the needle 4*fa* of the front bed FB is selected by the needle selection element A and is raised to an A position. Thereupon, the needle 4*fa* of the front bed FB catches the loop NL1 at the hook 27 thereof and is lowered as indicated by the position 5B in FIG. 5A, and also the transfer jack 11 is retracted. As the carriage advances, the transfer jack 11 is selected by the transfer jack selection member 18, and the rocking cam 16 (either 16*a* or 16*b*) rocked by a rocking movement of the rocking arm 19 of the corresponding solenoid shown in FIG. 1 is engaged with the projection 14 of the transfer jack 11 so that the projection 14 is pushed at the tail portion thereof by the rocking cam 16 to advance the holding piece 15. Thus, as the carriage advances, the selected transfer jack butt 13 rises along the branch path 76 of the transfer jack guide cam 20 and advances the holding piece 15 of the transfer jack 11 most at the position 5C.

Meanwhile, the needle jack butt 38 rises to the high summit portion 60H along the butt raising face 61 of the raising cam 51 to raise the needle 4*fa* most, and during the rising movement, the needle jack butt 38 draws the slider 24 so that it rises together with the slider 24. The needle jack butt 38 is lowered by the guard cam 52 and the needle transfer cam 64 in its projected position. However, the slider operating butt 30 of the slider 24 is further raised by the slider transfer cam 65, and also the tongue 37 is raised.

Since the loop NL1 which has formerly been held on the hook 27 of the needle 4*fa* is held at a lower portion of the needle body than the throat portion 28 (refer to FIG. 2) as a result of the rising movement of the needle body 21, when the needle jack 25 advances, the tongue 37 can be inserted into the loop NL1 held at the shoulder 36 of the tongue 37.

As the carriage advances, the needle jack butt 38 lowered by the needle transfer cam 64 jumps, because the selector jack butt 39 is treadled down by the trailing side A presser 54, over and enters a crossing path 63, along which the needle jack butt 38 thereafter moves horizontally. Consequently, the holding piece 15 of the transfer jack 11 and the tongue 37 of the hook 27 are advanced or raised most and both hold the loop NL1 thereof. However, the hook of the needle 4*fa* is lowered to a position near to the lowest position (position SC).

As the carriage further advances, the needle jack butt 38 is lowered to its lowest position and also the slider 24 is lowered a little to retract the tongue 37 from the loop NL1 (position 5D), and then, after the slider 24 is lowered to the lowest position, the tongue 37 assumes a position in which it closes up the hook 27 (position 5E) By the steps described above, the loop NL1 of the needle 4*fa* is transferred to the holding piece 15 of the transfer jack 11.

Thereafter, the loop NL1 having been transferred to the transfer jack 11 is held to another needle 4*fb*. The carriage is reversed conversely to that in the steps described above and moves from the left to the right in FIG. 6A. Before the carriage is moved, racking is performed so that the needle 4*fb* to receive the loop NL1 to be held may be opposed to the transfer jack on which the loop NL1 is held. A loop NL2 is caught in the hook 27 of the needle 4*fb*. Then, the carriage is reversed and moved reversely. In this process, since the needle 4*fb* to which the loop NL1 is to be held is required to be raised only to the height of the holding piece 15 of the transfer jack 11 on which the loop NL1 is held, the needle jack butt 38 is raised by the needle holding cams 72 without using the raising cam, and the slider 24 is operated by the slider holding cams 73.

In the example shown in FIGS. 6A to 6E, the loop NL1 is held on the tongue 37 of the slider 24 of the needle 4*fb* which has the loop NL2 in the hook 27 thereof. In particular, after the carriage is reversed, the needle jack butt 38 and the slider operation butt 30 are raised at the position 6B by the needle holding cams 72 and the slider holding cams 73, respectively. At this time, the needle 4*fb* holds the loop NL2 in the hook 27 and maintains the closed condition of the hook with the hook 27 and the tongue 37 contacted with each other, and inserts the hook 27 into the loop NL1 held on the holding piece 15 of the transfer jacks 11 (position 6B).

Then, the needle jack butt 38 is lowered along the 72*a* of the needle holding cams 72 and also the slider operation butt 30 is lowered along an outer periphery path 73*a* of the slider holding cam 73, and also the butt 13 of the transfer jack 11 is lowered along an outer periphery path 74*a* of the transfer jack transfer cam 74 by the transfer jack transfer cam 74. Since the amount of the lowering movement of the tongue 37 of the slider 24 is smaller than that of the lowering movement of the hook 27 of the needle 4*fb*, the loop NL1 left on the tongue 37 is positioned above the needle loop NL2 held on the hook 27 (position 6C). Then, by advancement of the transfer jack butt 13 which has passed the outer periphery path of the transfer cam 74, the transfer jack 11 advances the holding piece 15 again (position 6D), and the transfer jack butt 13 passes the advancement path 78 and is retracted by the retraction path 77 so that it returns to its original position (position 6E). By the process, the needle loop NL2 is held on the hook 27 of the needle 4*fb* and the loop NL1 is held on the tongue 37, and the needle 4*fa* has successfully been made an empty needle.

Figure 7B:
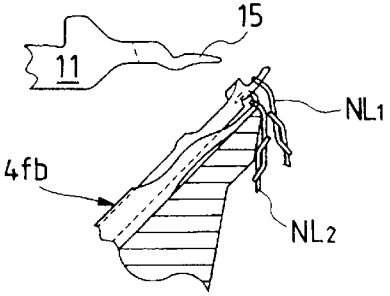
FIG. 7A shows 7B and 7C positions of the needle on the carriage and FIGS. 7B and 7C show relative positions of the needle and the transfer jack on the needle bed corresponding to the 7B and 7C positions.
Figure 7C:
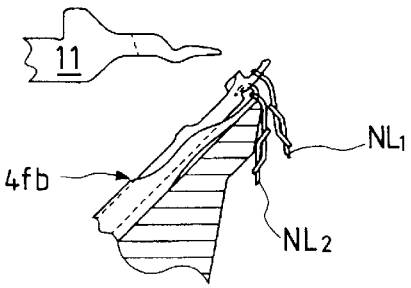
Figure 7A:
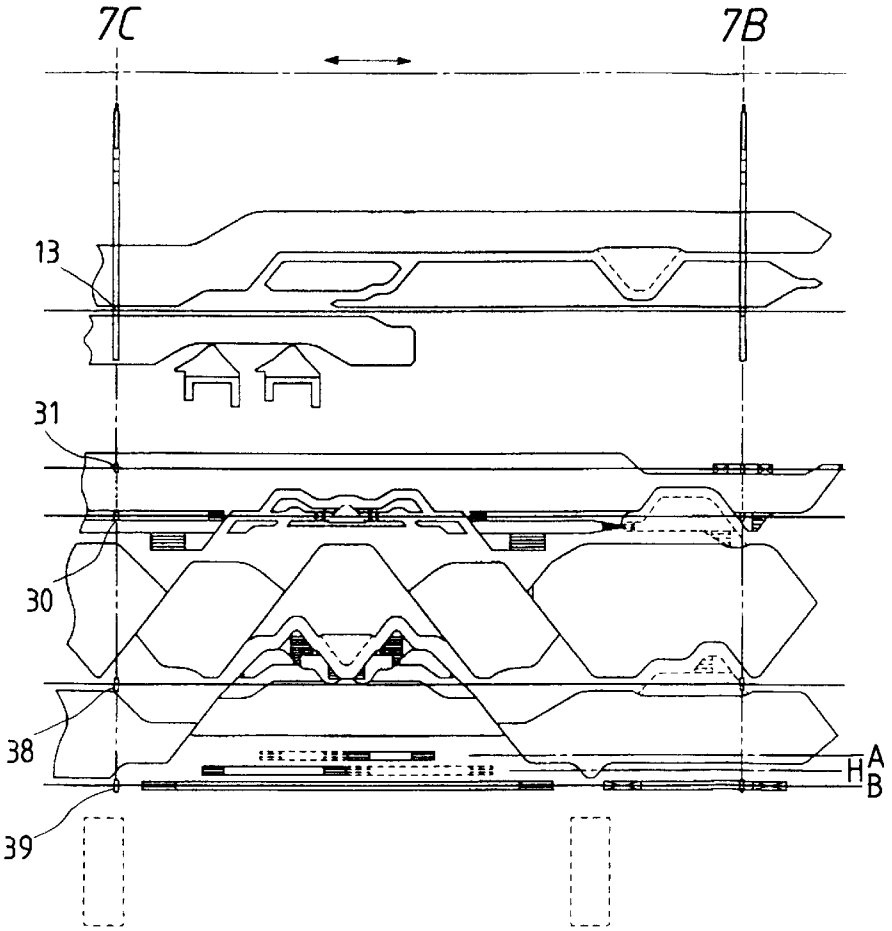
Figure 8B:
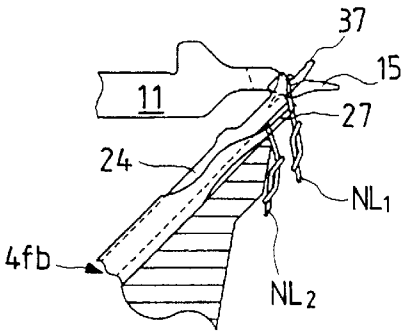
FIG. 8A shows 8B and 8C positions of the needle on the carriage and FIGS. 8B and 8C show relative positions of the needle and the transfer jack on the needle bed corresponding to the 8B and 8C positions.
Figure 8C:
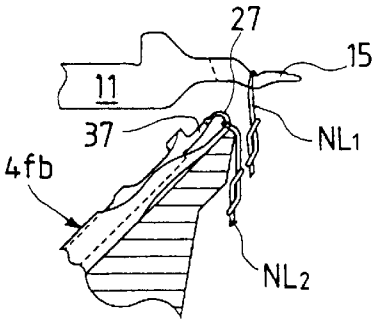
Figure 8A:
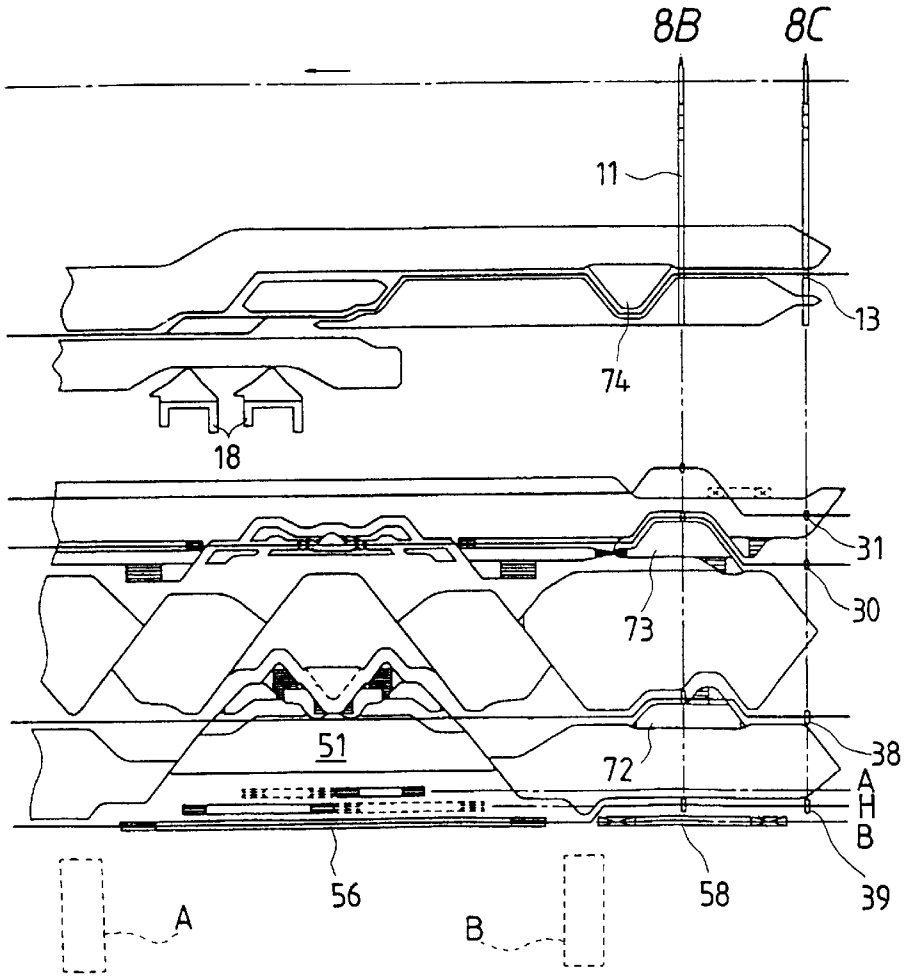

Knitting of some other suitable stitch is performed using the needle 4*fa* which has been made an empty needle, and back and forth movements of the c During such movements During such movements of the carriage, the selector jack butt 39, needle jack butt 38, slider operation butt 30, auxiliary butt 31 and transfer jack butt 13 of the needle 4*fb* moves back and forth straightforwardly without being moved upwardly and downwardly as shown in FIGS. 7A to 7C and also the selector jack 11 of the needle 4*fb* is not moved upwardly or downwardly, or in other words, not advanced or retracted (positions 7B, 7C).

Now, a process of returning the loop NL1 held on the needle 4*fb* to the original needle 4*fa* is described.

Simultaneously when the transfer jack 11 selected by the transfer jack selection member 18 is advanced as described above, the selector jack butt 39 is passed through the B presser 56 so that the needle jack butt 38 is not engaged with but passes by the raising cam 51. After the selector jack butt 39 passes through the presser 56, it is selected by the needle selection element B on the trailing side and comes to the H position, in which it is not engaged with or pushed down by a presser 58 and consequently also the needle jack butt 38 remains in the projected position. Consequently, the needle jack butt 38 is engaged with the needle holding cam 72 and raises the hook of the needle 4*fa*.

At this time, the needle jack butt 38 passes the needle holding cam 72 at the height of the shoulder portion without being raised to the top of the needle holding cam 72. On the other hand, since also the slider butt 30 is raised by the slider holding cam 73, also the tongue 37 of the slider 24 rises while holding the needle loop NL1 thereon so that the needle loop NL1 is advanced to the height of the advancing locus of the tongue of the advanced transfer jack 11. The height of the hook 27 then is a little lower than the height of the tongue 37 due to a difference in height between the needle holding cam 72 and the slider holding cam 73.

Then, the transfer jack butt 13 which has passed and has been lowered once by the transfer cam 74 advances so that the holding piece 15 of the transfer jack 11 enters the needle loop NL1 held on the tongue 37 (position 8B).

The needle jack butt 38 and the slider operation butt 30 which have passed the needle holding cams 72 and the slider holding cams 73 are both lowered, and the hook 27 and the tongue 37 are both lowered. Consequently, the needle loop NL1 is transferred to the holding piece 15 of the transfer jack 11 while the needle loop NL2 remains in the hook 27 of the needle 4*fb* (position 8C).

Figure 9B:
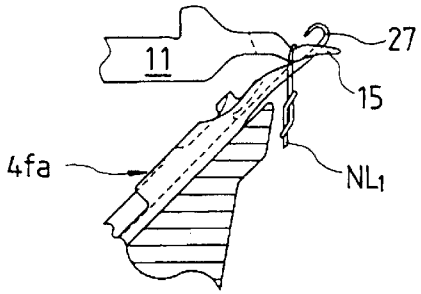
FIG. 9A shows 9B and 9C positions of the needle on the carriage and FIGS. 9B and 9C show relative positions of the needle and the transfer jack on the needle bed corresponding to the 9B and 9C positions.
Figure 9C:
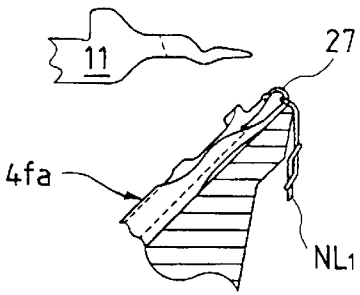
Figure 9A:
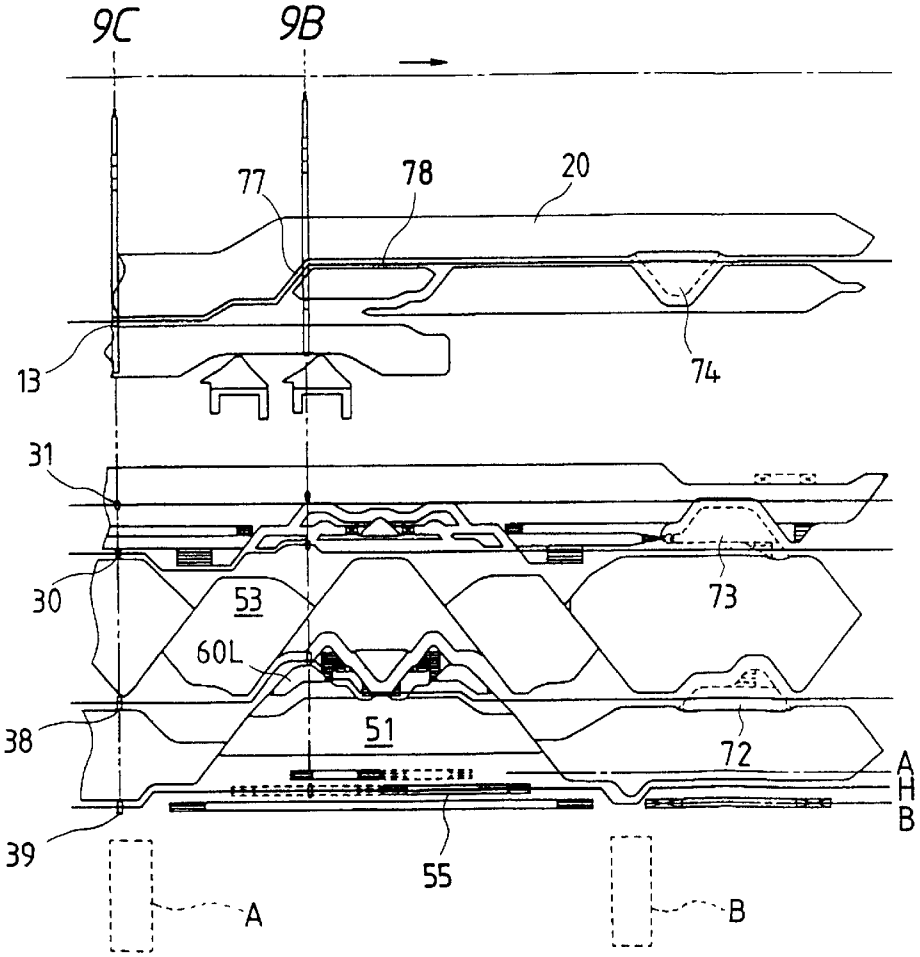

Then, in order to return the needle loop NL1 held by the transfer jack 11 to the original needle 4*fa* (now an empty needle) or a different empty needle, racking is performed so that the transfer jack 11 and the needle 4*fa* or the different empty needle may oppose to each other and the carriage is moved rightwardly (FIGS. 9A to 9C). The example shown indicates an example wherein the needle loop NL1 is returned to the needle 4*fa*. At this time, the needle holding cams 72, slider holding cams 73 and transfer cam 74 are all positioned to their non-projected positions, and the needle jack butt 39 of the needle 4*fa* is selected to the H position and jumps, as the half pressers 54 are in their projected positions, over the leading side mountain of the raising cam 51, whereafter it is raised to the low summit portion 60L of the trailing side mountain to raise the hook 27. As a result of the rising movement, the hook 27 of the needle 4*fa* which has been an empty needle enters the loop NL1 held on the holding piece 15 of the transfer jack 11 whose which transfer jack butt 13 has been positioned in the advancement path 78 of the transfer jack guide cam 20 and has been advanced most (position 9B).

By further movement of the carriage, the transfer jack butt 13 is retracted along the retraction path 77, and the needle loop NL1 escapes from the holding piece 15 of the transfer jack 11 and is now held by the hook 27 of the needle 4*fa*. The needle jack butt 38 is lowered by the knitting cam 53, and the slider operation butt 30 is lowered once and then raised to close the hook 27 (position 9C).

Since, in the embodiment described above, since the needle holding cams 72 and the slider holding cams 73 are provided separately from and on the right side of needle operation means for knitting stitch loops composed of the raising cam 51 and so forth, this gives rise to a restriction with regard to the advancing direction of the carriage that holding of a loop cannot be performed except when the carriage moves in the rightward direction. However, if such holding cam is provided on each of the opposite ends of the carriage, then the restriction with regard to the advancing direction described above can be eliminated.

A second embodiment of the present invention is described below. It is to be noted that similar members to those of the first embodiment are described with similar reference symbols applied thereto. The second embodiment is similar to the first embodiment in needle beds and compound needles inserted in the needle beds, but is different in a cam arrangement of a carriage. While, in the first embodiment, a loop of a first needle is held on a second needle of the same bed through a transfer jack, in the second embodiment, a loop is directly held on a needle of an opposing bed.

Figure 10:
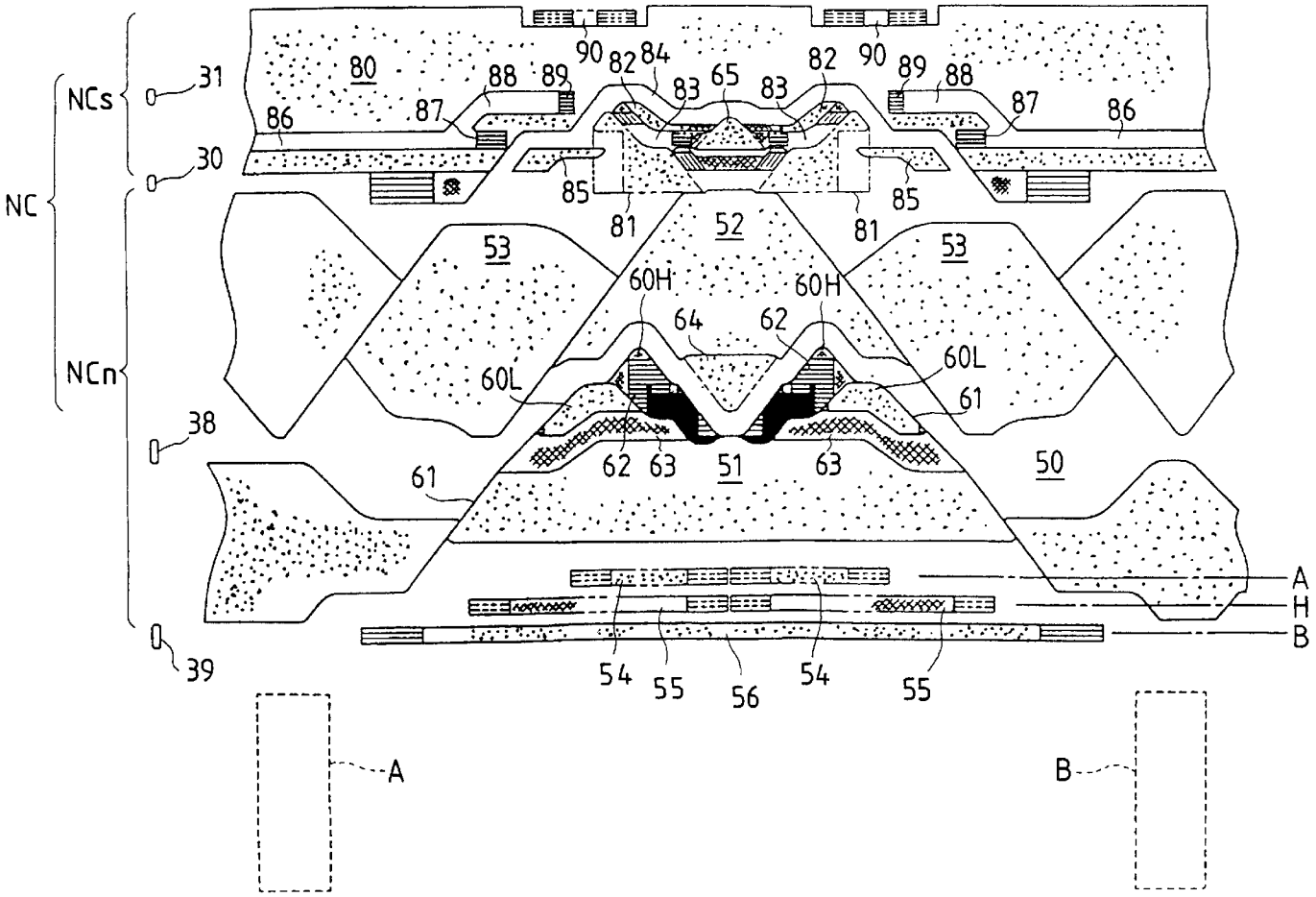
FIG. 10 shows a needle operating cam NC in a second embodiment as viewed from below.

The cam arrangement of the carriage in the second embodiment is described below. FIG. 10 shows a needle operating cam set disposed on a base plate 50 of the carriage as viewed from below.

A needle operating cam NC includes a needle body operating cam set NCn and a slider operating cam set NCs. The needle body operating cam set NCn includes a raising cam 51, a guard cam 52 provided above the raising cam 51, a pair of knitting cams 53 on the opposite sides of the raising cam 51 and a pair of A pressers 54 and a pair of half pressers 54 provided below the raising cam 51 for individual movement to and from a projected position, and a B presser 56 fixed in a normally projected condition below the half pressers 54. The heights (butt pressing amounts) of the pressers mentioned above are such that the A pressers 54 and the B presser 56 have a maximum or full height and the half pressers 54 have a half height. A pair of needle selection elements (actuators) A, B for selecting one of paths to the pressers are provided on the leading sides of and below the B pressers when the carriage advances.

The raising cam 51 has two left and right mountains including a pair of mountain-shaped high summit portions 60H and a pair of low summit portions 60L having a height equal to the height of shoulders of the high summit portions 60H, and outer side walls of the mountains serve as butt raising faces 61 while inner side walls opposing to each other are formed as inclined faces 62 so as to allow jumping over of the high summit portions 60H. Below the two high summit portions 60H, a pair of crossing paths 63 connecting to the lowest position between the two high summit portions 60H, 60H are provided. Part of a lower portion of the guard cam 52 positioned between the two high summit portions 60H, 60H described above is provided for projecting movement as a needle transfer cam 64 of an inverted triangular shape.

The slider operating cam set NCs is centered commonly to the needle body operating cam set NCn and is provided in a slider cam 80 in an opposing relationship to the top of the guard cam 52. A slider transfer cam 65 is provided for movement to and from a projected position in the middle of the slider cam 80. A pair of slider holding cams 81, 81 each movable to and from a projected position and a pair of fixed delivery slider advancing cams 82, 82 are provided on the opposite sides of the slider transfer cam 65 such that a pair of receiver slider raising grooves 83, 83 are defined between the slider holding cams 81, 81 and the delivery slider advancing cams 82, 82.

The delivery slider advancing cams 82, 82 are disposed in a truncated inverted V-shaped configuration on the left and right of the slider transfer cam 65, and a delivery slider guide groove 84 is provided along the top edges of the delivery slider advancing cams 82, 82. The delivery slider guide groove 84 has the highest position at positions thereof opposing to the top edges of the deliver slider advancing cams 82 and then extends downwardly, whereafter it extends in a horizontal direction once at upper edges of guide cams 85 and then extends downwardly. The slider cam 80 has a pair of horizontal grooves 86 provided thereon at a height equal to that of the delivery slider guide groove 84 which extends in a horizontal direction above the guide cams 85. Although the horizontal grooves 86 do not connect directly to the delivery slider guide groove 84, a slider butt can advance from any of the horizontal grooves 86 into the corresponding delivery slider guide groove 84 by jumping from a corresponding inclined face 87. The slider cam 80 has a pair of advanced slider receiving grooves 88 branching from and extending in parallel to the horizontal grooves 86 above the horizontal grooves 86, and inclined faces 89 at end portions of the advanced slider receiving grooves 88 are positioned adjacent end portions of the receiver slider raising grooves 83 in the proximity of the top portions of the slider holding cams 81. Reference 90 denotes a holding slider, and a pair of left and right holding pressers 90 are provided for movement to and from a projected position in order that, when a slider butt 30 tries to advance from one of the receiver slider raising grooves 83 into the corresponding advanced slider receiving groove 88, the corresponding holding presser 90 may push the slider butt 30 in so that the slider butt 30 may jump from the reception slider raising groove 83 over to the corresponding inclined face 89.

Figure 11:
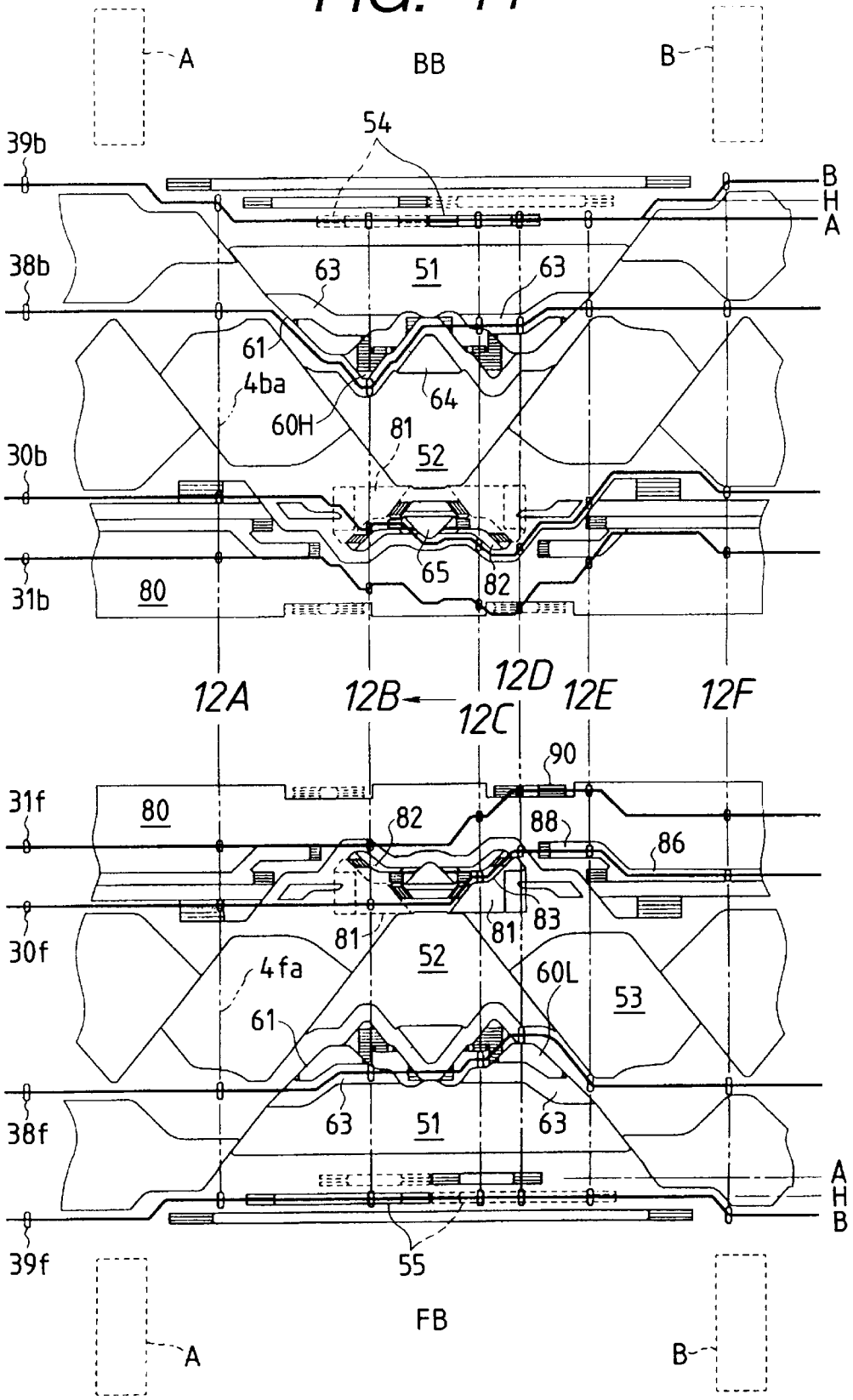
FIG. 11 shows 12A to 12F positions of a needle on the carriage in the second embodiment.
Figure 12A:
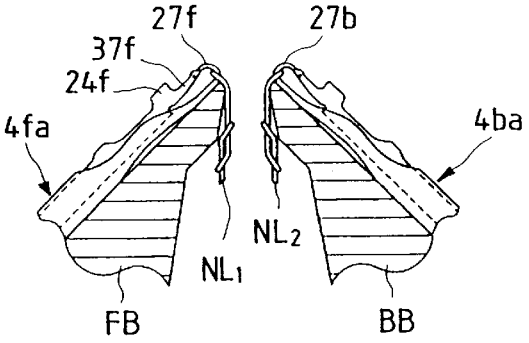
FIGS. 12A to 12F show positions of a needle bed and the needle corresponding to the positions of FIG. 11.
Figure 12D:
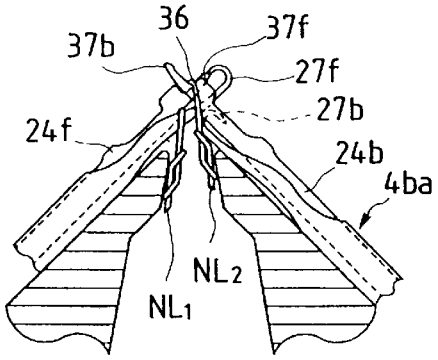
Figure 12B:
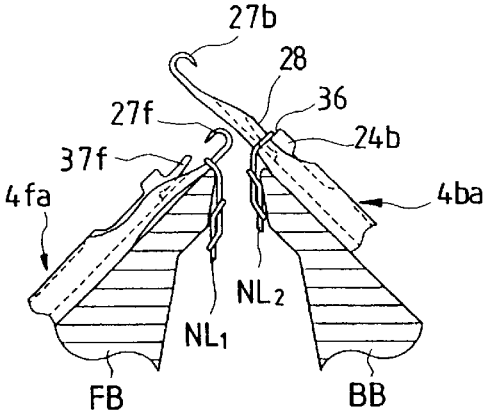
Figure 12E:
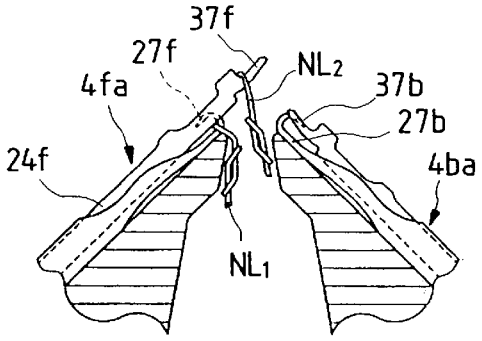
Figure 12C:
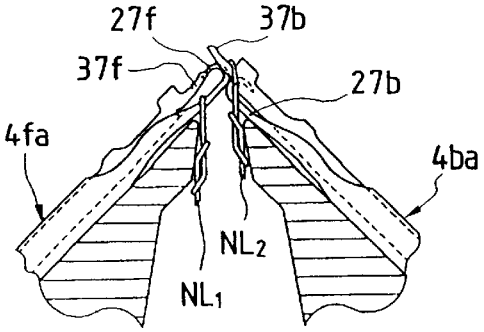
Figure 12F:
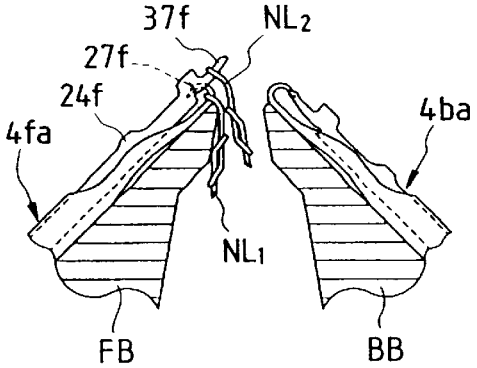
Figure 13:
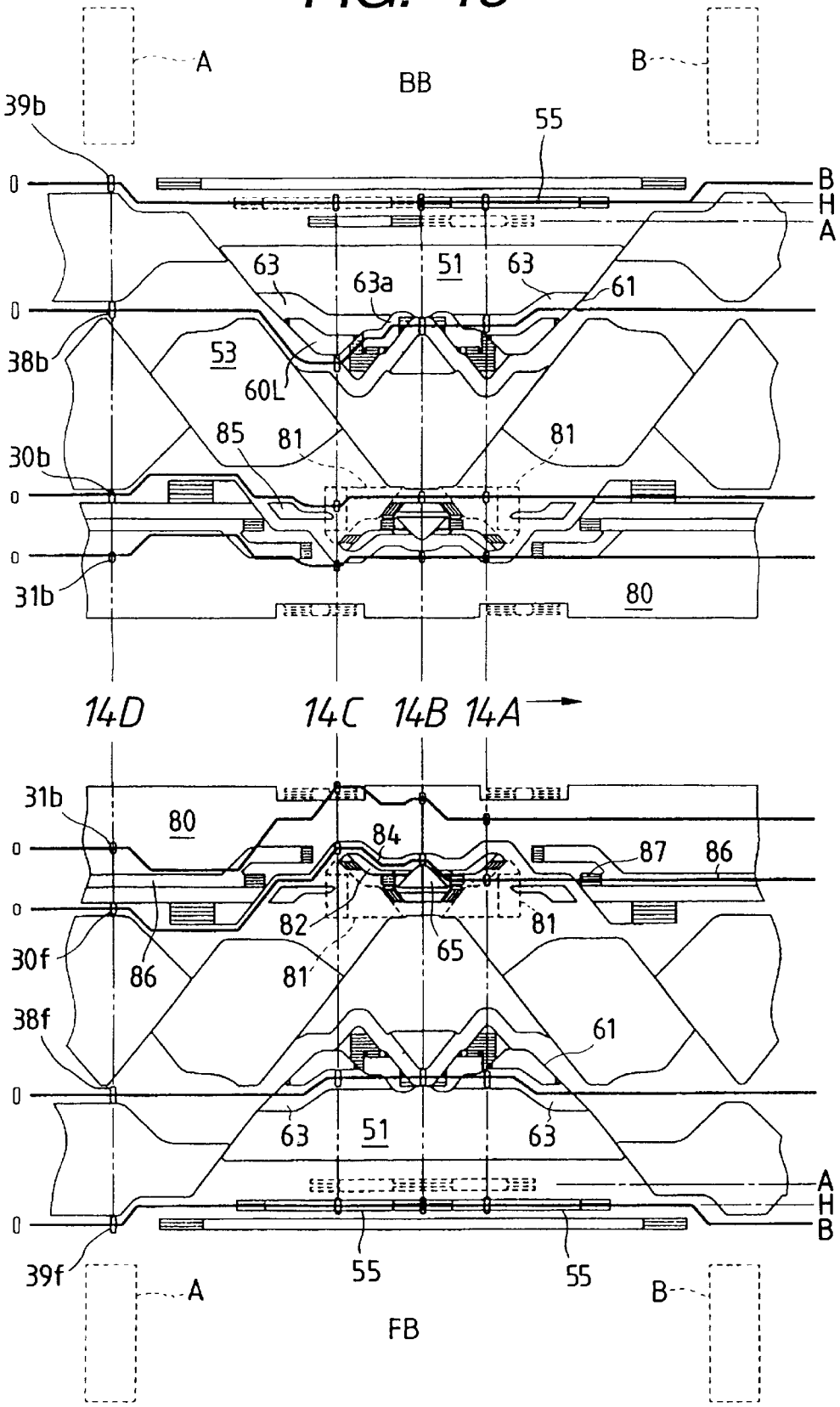
FIG. 13 shows 14A to 14D positions of the needle on the carriage in the second embodiment.

While the process therefor is described with reference to FIGS. 11 to 14, FIGS. 11 and 13 show loci of a selector jack butt 39, a needle jack butt 38, a slider jack butt 30, an auxiliary slider butt 31 and a transfer jack butt 13 on the cam plane and FIGS. 12A to 12F and FIGS. 14A to 14D illustrate raised and lowered or advanced and retracted conditions of the compound needle 4 (f4*a*, 4*fb*) and the transfer jacks 11 at different positions in the loci together with cross sections of the needle bed FB. It is to be noted that FIGS. 11 and 13 show the front bed side carriage portion on the nearer side and show the back bed side carriage portion on the farther side and the carriages advance in a direction indicated by an arrow mark at the center.

In the present example, particularly a loop NL2 of a needle 4*ba* of the back bed BB is held on the tongue 37*f* of the slider 24*f* of a needle 4*fa* of the front bed FB to make the needle 4*ba* an empty needle and, after the needle 4*ba* is used suitably, the needle 4*ba* as an empty needle receives the loop NL2 returned from the tongue 37*f* of the needle 4*fa* of the front bed FB.

Referring to FIG. 11, as the carriage moves leftwardly, the needle 4*ba* which is to hold the loop NL2 and the needle 4*fa* to which the loop NL2 is to be held are selected to the A position and the H position (the position 12A of FIG. 11 corresponds to a condition wherein the needle 4*fa* is advanced to the H position) by the needle selection element A on the back bed BB side and the front bed FB side, respectively. At this time, since the needle jack butts 38*b*, 38*f* are not raised on any of the holding side (back bed BB side) and the held side (front bed FB side), neither of the hook 27*b* and the hook 27*f* is raised (FIG. 12A).

Thereafter, while the selector jack butt 39*b* of the holding side is raised to the A position, since the A presser 54 on the leading side is in the non-projected position, as the carriage advances, the needle jack butt 38*b* is raised along the butt raising face 61 of the raising cam 51 up to the high summit portion 61H to raise the hook 27*b* of the needle 4*ba* most. At this time, since the slider holding cam 81 is in its non-projected position, the slider 24*b* is raised without engaged at the slider butt 30*b* thereof with the slider holding cam 81 as the needle 4*ba* is raised and receives, at the shoulder 36 of the tongue 37*b* thereof, the loop NL2 which has been held on the hook 27*b* of the needle 4*ba* and is moved to the throat portion 28 of the needle. The selector jack butt 39*f* of the needle jack butt 38*f* of the left side is pushed a little into the needle trick because the half presser 55 of the leading side is in its projected position and advances straight forwardly without engaged with the butt raising face 61 of the raising cam 51 until it enters the crossing path 63. However, since the needle jack butt 38*f* is in a half projected state, the selector jack butt 39*f* of the needle jack butt 38 is engaged with a path wall of the crossing path 63 and is a little raised midway. However, since the slider holding cam 81 of the leading side is in its non-projected position, it advances straightforwardly without engaged with the slider holding cam 81 and is not raised while only the hook 27*f* of the needle 4*fa* is raised. Consequently, the hook 27*f* and the tongue 37*f* are opened (the position 12B of FIG. 11 and FIG. 12B).

After the position 12B is passed, on the holding side, the needle jack butt 38*b* is lowered to the height of the crossing path 63 by the guard cam 52 and the needle transfer cam 64 which is in its projected position, and since the trailing side A presser 54 is in its projected position, the selector jack butt 39*b* is pushed into the needle trick by the A presser 54 and also the needle jack butt 38*b* is pushed in similarly, whereafter the needle jack butt 38*b* moves horizontally as it is and enters the crossing path 63. Since the slider butt 30*b* is raised by the slider transfer cam 65 which is in its projected position, the loop NL2 which has been at the throat portion 38 of the needle 4*ba* is engaged with and raised by the tongue 37*b* while the hook 27*b* is lowered.

On the other hand, on the left side, since the trailing side half presser 54 is in its non-projected position, the selector jack butt 39*f* and the needle jack butt 38*f* remain projected, and the needle jack butt 38*f* is raised along the trailing side low summit portion 60L of the raising cam 51 to the tuck level. The slider butt 30*f* is raised by the slider holding cam 81 since the slider holding cam 81 is in its projected position. Since the raised amount of the slider butt 30*f* then is larger than that of the needle jack butt 38*f*, the hook 27*f* of the needle 4*fa* is closed up with the tongue 37*f* (12C of FIGS. 11, 12).

Then, on the holding side, since the needle jack butt 38*b* moves horizontally along the crossing path 63 of the raising cam 51, the hook 27*b* is not raised but remains stationary. However, since the slider butt 30*b* is raised along the delivery slider advancing cam 82, the slider 24*b* raises the tongue 37*b* most. As a result of the rise, the needle loop NL2 of the hook 27*b* is engaged with and lifted by the shoulder 36 of the tongue 37*b*. On the receiving side, since the needle jack butt 38*f* is raised to the tuck position of the trailing side low summit portion 60L of the raising cam 51 and the slider butt 30*f* is raised to the highest position by the slider holding cam 81, the hook 27*f* is inserted into the needle loop NL2 held on the tongue 37*b* of the holding side slider 24*b* while it remains closed with the tongue 37*f* (12D of FIG. 11 and FIG. 12D).

After the left side hook 27*f* is inserted into the holding side loop NL2, the slider butt 30*b* of the holding side needle 4*ba* is lowered along the lowering oblique face of the slider cam 80 and also the needle jack butt 38*b* is lowered by the slope of the end portion of the crossing path 63 of the raising cam 51, and the needle 4*ba* of the holding side is returned to its original position with the hook 27*b* closed with the tongue 37*b*. The needle 4*fa* of the left side is lowered after the needle 4*ba* of the holding side is lowered. In particular, since the holding presser 90 is in its projected position, the auxiliary butt 31 is pushed into the needle trick by the holding presser 90 and also the slider butt 30*f* is pushed into the needle trick by the same, and consequently, at a position after it goes out from the reception slider raising groove 83, the slider butt 30*f* is disengaged from the groove wall of the slider cam 80. Consequently, the slider butt 30*f* jumps over into the advanced slider receiving groove 88 which extends horizontally. Meanwhile, since the needle jack butt 38*f* is lowered by the knitting cam 53, the hook 27 returns to its original position, and consequently, only the slider 24*f* keeps its high position while it holds the loop NL2 held on the tongue 37*f* (12E of FIG. 11 and FIG. 12E)By a leftward movement of the carriage after that, the needle jack butt 38*f* of the left side moves horizontally and also the hook 27*f* maintains its first position, and the slider butt 30*f* enters the horizontal groove 86 from the advanced slider butt receiving groove 88 and lowers the tongue 37*f*. However, the lowered position of the tongue 37*f* is a little higher than the first position. Also the selector jack butt 39*f* is lowered to the B position, and all members on the holding side have their returned first positions (12F of FIG. 11 and FIG. 12F).

By the operation described above, the needle loop NL2 which was held on the hook 27*b* of the needle 4*ba* of the back bed BB is held on the tongue 37*f* of the slider 24*f* of the needle 4*fa* of the front bed FB and the needle 4*ba* of the back bed BB is empty. Therefore, the needle 4*ba* performs knitting suitably in combination with some other needle or needles, and after this knitting is completed, the needle loop NL2 held on the tongue 37*f* of the needle 4*fa* is returned to the needle 4*ba*. It is to be noted that returning of a loop is not limited to returning to a needle on which the loop to be returned was held initially as described above, but may be returning to some other needle.

The returning operation mentioned above is described below.

The carriage is reversed and advances rightwardly in a direction indicated by an arrow mark in FIG. 13. At this time, the left and right slider holding cams 81, 81 are in their non-projected positions. The returning operation returns the needle loop NL2 of the tongue 37*f* of the needle 4*fa* of the front bed FB to the hook 27*b* of the needle 4*ba* of the back bed BB. Upon the rightward movement of the carriage, the needle 4*fa* is selected to the H position by the needle selection element B of the returning side front bed FB side. The half pressers 55, 55 are projected on both of the leading side and the trailing side. Consequently, since the needle jack butt 38*f* is pushed into the needle trick and also the needle jack butt 38*f* is pushed in, the needle jack butt 38 jumps over the butt raising face 61 of the raising cam 51 without engaged with the same and advances into the crossing path 63 of the raising cam 51. Meanwhile, the slider butt 30*f* is in the horizontal groove 86 and rides on and jumps over the inclined face 87 at the end portion of the horizontal groove 86, and since the slider holding cam 81 is in its non-projected position, the slider butt 30*f* advances straightforwardly as it is. On the receiving side, the needle 4*ba* is selected to the H position by the needle selection element B of the back bed BB side, and the selector jack butt 39*b* is pushed in by an amount equal to a half height to the needle trick by only a leading side one of the half pressers 54 which is in its projected position and also the needle jack butt 38*b* is pushed in. Consequently, the selector jack butt 39*b* jumps over the butt raising face 61 of the raising cam 51 and advances into the crossing path 63 of the raising cam 51, and then it is raised a little midway of the crossing path 63. The slider butt 30*b* advances straightforwardly along a lower edge upper edge in FIG. 13) of the slider cam 80. Accordingly, the hooks 27*f* on both of the returning side and the receiving side are raised only a little (14A of FIG. 13 and FIG. 14A).

By a succeeding rightward movement of the carriage, the selector jack butt 39*f* of the front bed FB of the returning side continues to be pushed by the half presser 54, and the needle jack butt 38*f* moves horizontally along the crossing path 63 of the raising cam 51. The slider butt 30*f* is raised by the slider transfer cam 65 and enters the delivery slider guide groove 84, in which it is raised a little while the tongue 37*f* of the slider 24*f* holds the loop NL1 thereon. On the back bed BB of the receiving side, the needle jack butt 38*b* moves horizontally similarly to the needle jack butt 38*f* at the height of the back bed BB of the returning side and the hook 27*b* does not change its height. The slider butt 30*b* advances straightforwardly along a lower edge (upper edge in FIG. 13) of the slider cam 80, and since the slider holding cam 81 is in its non-projected position, the slider butt 30*b* is not influenced by the slider holding cam 81 and the slider 24*b* keeps its stationary state without being displaced. Accordingly, the hook 27*b* and the tongue 37*b* both remain in their stationary condition (14B of FIG. 13 and FIG. 14B) Then, as the carriage moves, the needle jack butt 38*f* of the front bed FB of the returning side advances straightforwardly along the crossing path 63 and the hook 27*f* of the needle 4*fa* does not exhibit a variation. However, the slider butt 30*f* is raised along the delivery slider advancing cam 82 in the delivery slider guide groove 84 to project the tongue 37*f* of the slider 24*f* most. At this time, on the receiving side, the needle jack butt 38*b* which has advanced straightforwardly in the crossing path 63 comes to a branching cam 63*a* of a height further smaller than the half height provided at an intermediate portion of the crossing path 63 and moves along a wall on the boundary between the crossing path 63 and the branching cam 63*a*, whereupon it is spaced away from the crossing path 63 so that it advances to the low summit portion 60L side. Then, the needle jack butt 38*b* is raised along the low summit portion 60L of the trailing side of the raising cam 51 and inserts the hook 27*b* thereof into the needle loop NL2 held on the tongue 37*f* (14C of FIG. 13 and FIG. 14C).

Then, the needle jack butt 38*f* of the returning side advances along the crossing path 63 and is lowered a little at an exit of the crossing path 63 so that it returns to its original position, and the slider butt 30*f* is lowered along the inclined face of the slider cam 80 to its original position. Thereupon, by the lowering movement of the slider butt 30*f*, the loop NL2 of the tongue 37*f* is removed and thus remains on the hook 27*b* of the receiving side. On the receiving side, a little later than the lowering movement on the returning side described above, the needle jack butt 38*b* is lowered by the knitting cam 53, and the slider butt 30*b* is lowered by the guide cam 85 along a locus similar to the lowering locus of the needle jack butt 38*b*.

Figure 14A:
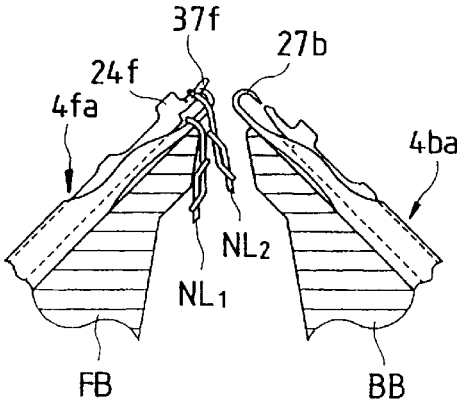
FIGS. 14A to 14D show positions of the needle bed and the needle corresponding to the positions of FIG. 13.
Figure 14C:
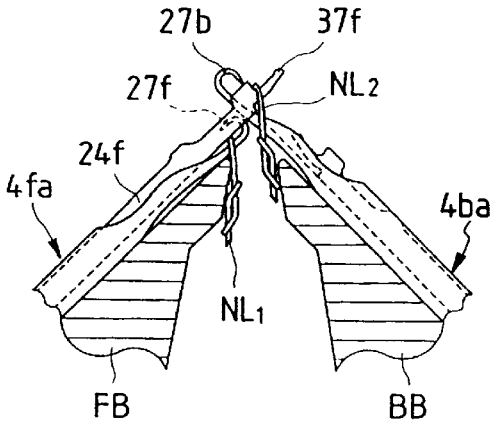
Figure 14B:
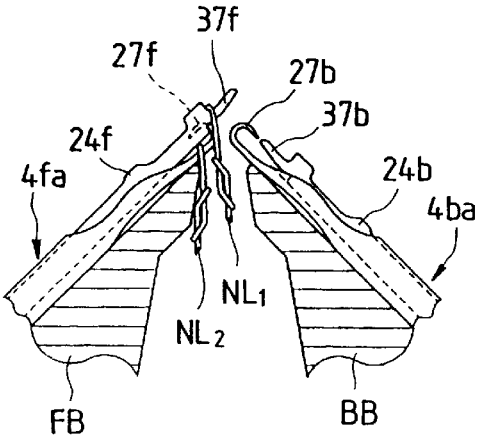
Figure 14D:
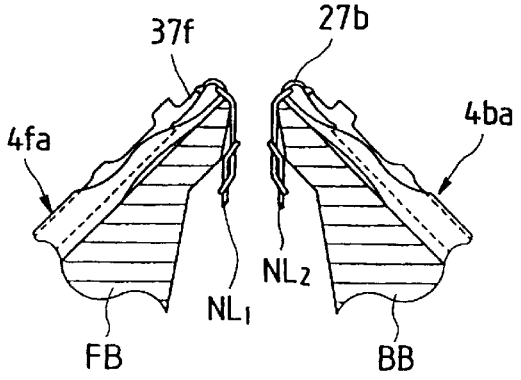
Figure 15A:
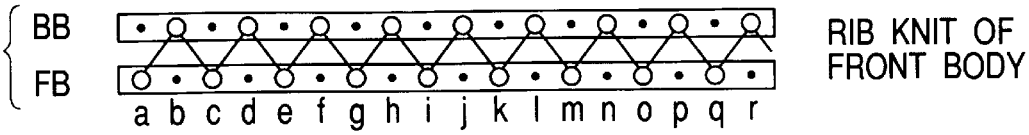
FIGS. 15A to 15G are views showing knitting steps from a waist band to a body part.
Figure 15B:
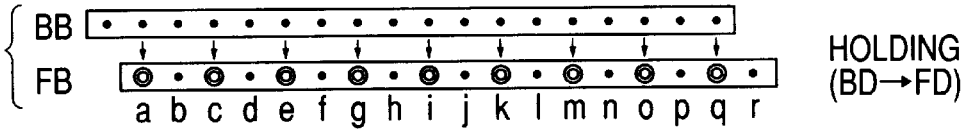
Figure 15C:
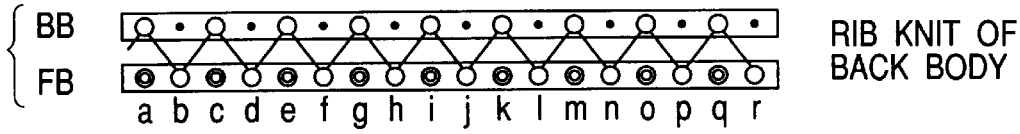
Figure 15D:
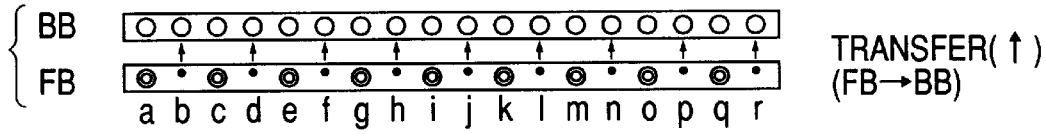
Figure 15E:
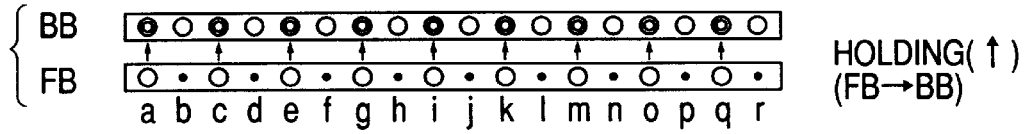
Figure 15F:
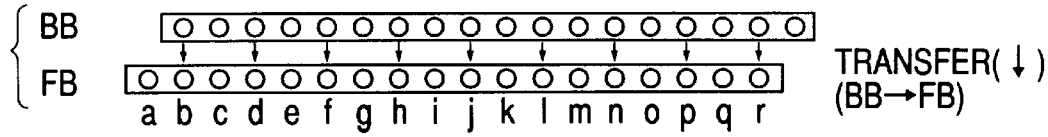
Figure 15G:
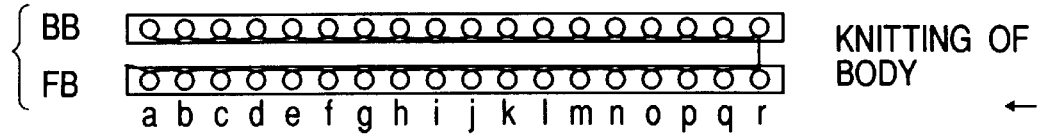

Consequently, the needle loop NL1 is held on the needle 4*fa* of the front bed FB and the needle loop NL2 is held on the needle 4*ba* of the back bed BB, and this signifies that they have returned to the original positions (14D of FIG. 13 and FIG. 14D).

Now, knitting of a knit fabric in which the present stitch loop holding apparatus is used is described below.

The knitting mentioned is an example wherein a waist band part of a 1×1 rib stitch is knitted at each of bottom portions of a front body and a back body of a knit fabric which is knitted in a tubular form by connecting the opposite ends of the front body and the back body which have a plain stitch structure, and FIGS. 15A to 15G illustrate knitting steps from the waist band parts to the body parts. First in step 1 (FIG. 15A), a yarn is supplied to needles a, c, e, . . . of the front needle bed FB and needles b, d, f, . . . of the back needle bed BB to perform knitting of a course of the waist band part of the front body f side. The knitting in step 1 (FIG. 15A) is performed repetitively by a predetermined number of times to obtain a waist band part of a desired length. Then in step 2 (FIG. 15B), the stitch loops knitted by the needles b, d, f, . . . of the back needle bed BB are held on the needles a, c, e,. . . of the front needle bed FB on which the stitch loops of themselves are held.

This holding of the stitch loops is performed in accordance with the method described hereinabove. In next step 3 (FIG. 15C), knitting of a 1×1 waist band part of the back body part is performed by the needles a, c, e, . . . of the back needle bed BB and the needles b, d, f, . . . of the front needle bed FB. Also this knitting is performed repetitively by a predetermined number of times similarly to that of the waist band part of the front body part side of step 1 described above to obtain a waist band part of a desired length.

Knitting of the front and back waist band parts is completed by steps 1 to 3 described above, and in the following steps, knitting of separate transfer of the stitch loops for formation of the body parts to be performed subsequently to the knitting of the waist band parts is performed. In particular, in step 4 (FIG. 15D), the stitch loops of the waist band part of the back body side knitted with the needles b, d, f, . . . of the front needle bed FB are transferred to the empty needles b, d, f, . . . of the back needle bed BB, and in next step 5 (FIG. 15E), the stitch loops of the waste band of the front body side held in step 2 described above are held once on the needles a, c, e, . . . of the back needle bed BB on which the stitch loops are held. Then in step 6 (FIG. 15F), the back needle bed BB is racked in the rightward direction and the held stitch loops are transferred to the empty needles b, d, f, . . . of the front needle bed FB. Consequently, the needles of the front and back needle beds FB, BB come to a condition wherein they hold the stitch needles thereon, and thereafter, in step 7 (FIG. 15G), the body parts can be formed in a tubular fashion continuously to the waist band parts by supplying a yarn in a circulating manner in the clockwise direction to the needles of the back needle bed BB and then of the front needle bed FB.

Now, an example wherein a tubular knit fabric including a front side knit fabric and a rear side knit fabric having a 1×1 rib stitch structure and connected at the opposite ends thereof to each other is described. FIGS. 16A to 16G illustrate such knitting steps. In the present embodiment, a four-bed flat knitting machine wherein an additional pair of needle beds are disposed above front and back needle beds is used.

Figure 16A:
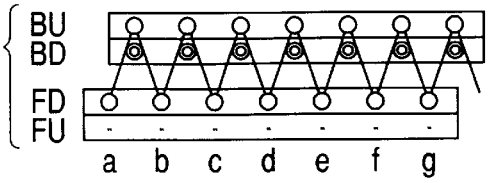
FIGS. 16A to 16G are views showing knitting steps for knitting a tubular knit fabric having a knit structure of a 1×1 rib stitch.
Figure 16B:
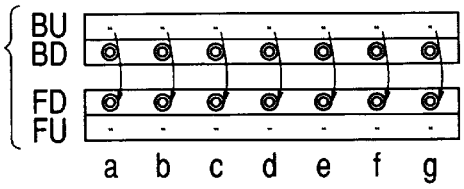
Figure 16C:
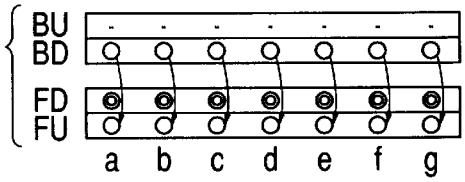
Figure 16D:
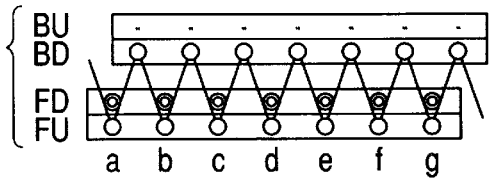
Figure 16E:
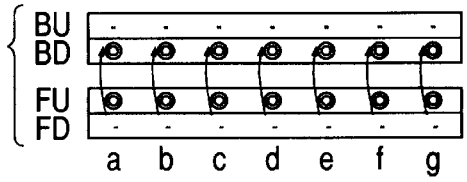
Figure 16F:
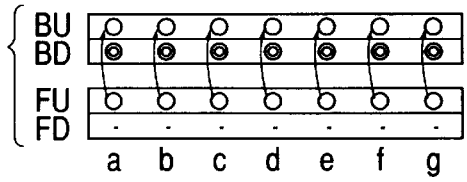
Figure 16G:
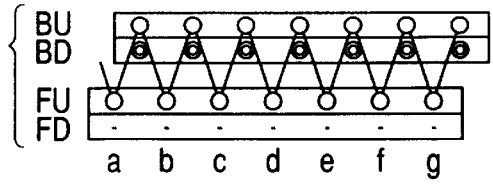

In step 1 (FIG. 16A) , knitting of a course of a front side knit fabric of a 1×1 rib stitch structure using needles a, b, c, . . . of the front lower needle bed FD and needles a, b, c, . . . of the back upper needle bed BU. At this time, as shown in FIG. 16A, a condition wherein stitch loops of a rear side knit fabric are held on needles a, b, c, . . . of the back lower needle bed BD, or more particularly, knit stitch loops of the back side knit fabric are held on the hooks of the needles of the back lower needle bed BD, and purl stitch loops of the back side knit fabric are held on the tongues of the sliders of the same needles, is maintained. Then, in order to perform knitting of a course of the back side knit fabric subsequently to the knitting of the course of the front side knit fabric, first in step 2 (FIG. 16B), the purl stitch loops of the front side knit fabric knitted by the needles of the back upper needle bed BU are held on the tongues of the sliders of the needles of the front lower needle bed FD, and then in step 3 (FIG. 16C), the purl stitch loops of the back side knit fabric held on the tongues of the sliders of the needles of the back lower needle bed BD are transferred to the needles of the front upper needle bed FU. In step 4 (FIG. 16D), knitting of a course of the back side knit fabric is performed using the needles a, b, c, . . . of the back lower needle bed BD and the needles a, b, c, . . . of the front upper needle bed FU. In the succeeding steps 5 to 7 (FIGS. 16E to 16G), knitting of a course of the front side knit fabric is performed subsequently to the knitting of the course of the back side knit fabric. In particular, in step 5 (FIG. 16E), the purl stitch loops of the back side knit fabric are held on the needles of the back lower needle bed BD, and in next step 6 (FIG. 16F), the purl stitch loops of the front side knit fabric which have been held on the needles of the front lower needle bed are held on the needles of the back upper needle bed, whereafter knitting of a course of the front side knit fabric is performed in step 7 (FIG. 16G). A tubular knit fabric of a 1×1 rib stitch structure is knit by repeating the knitting operations of steps 1 to 6 described above.

In the example described above, stitch loops of one of front and back knit fabrics which form a tubular knit fabric are held on one of the front and back lower needle beds FD, BD, and the other knit fabric part of the tubular knit fabric is knitted using the needles of the front lower needle bed FD on which the stitch loops are not held and the back upper needle bed BU opposing to the front lower needle bed FD. Depending upon the locations of the upper beds, when the needles of the upper needle bed located above the needles of the lower needle bed on which stitch loops are held advance toward the needle bed gap, they collide with the needles positioned below. In such an instance, a mechanism for retracting the sliders to such a degree that the stitch loops do not escape from the tongues of the needles on which the needle loops are held or for moving the lower needle bed to a retracted position retracted from the needle bed gap is provided additionally to the flat knitting machine to prevent such collision of the needles as described above.

By applying the apparatus of the present invention to a four-bed flat knitting machine in this manner, knitting of a knit fabric which cannot conventionally be knitted on a four-bed flat knitting machine becomes possible.

It is to be noted that the apparatus of the present invention can naturally be used, for example, to form a links-and-links pattern on a tubular knit fabric or to perform various manners of knitting of structure pattern including knitting of such patterns as a cable pattern and a mesh pattern or inner decreasing or narrowing knitting of a rib knit fabric.

While an example wherein loops are held on from needles to different needles using transfer jacks is presented by the first embodiment and another example wherein loops are held on from needles to different needles is presented by the second embodiment, the first embodiment may be modified to a type wherein needles are held on from needles to different needles by a holding cam provided in a different phase from the knitting cam of the first embodiment, and the second embodiment may be modified to another type wherein loops are held through jacks by a holding cam provided in the knitting cam.

In the second embodiment described above, since the holding cam is provided integrally with needle operation means for knitting stitch loops, the carriage can be made compact, and besides loops can be held irrespective of in which one of the leftward and rightward directions the carriage advances. However, if the stitch knitting lock itself which makes a base when the holding cam is to be incorporated is not symmetrical in the leftward and rightward directions and the holding cam is built in a type of a carriage whose directionality is restricted upon loop transfer or the like (for example, upon rightward movement, from the front to the back, upon leftward movement, from the back to the front), then the advancing direction of the carriage when holding is to be performed is restricted to one direction.

As described above, since it becomes possible to hold two stitch loops in a separate condition from each other in a hook and on a tongue of a slider of one needle by employing the apparatus of the present invention, even if there is no empty needle on the opposing needle bed, a needle loop can be exchanged between different needle beds. As a result, it is possible to reduce conventional restrictions as a fixed idea in regard to knitting of a knit fabric to achieve variety of knitting of knit fabrics, that is, to obtain a novel knit structure or achieve power saving in production of knit articles.

What is claimed is:

1. A stitch loop holding apparatus for a flat knitting machine comprising:

(i) compound needles provided in rows on at least one pair of front and back needle beds disposed in an opposing relationship to each other so as to define a needle bed gap;

each of said compound needles including a needle body and a slider constructed for movement relative to each other;

the slider of each of said compound needles comprising a tongue formed as a layered body of two thin resilient plate-shaped members;

a hook being provided at an end of the needle body;

said tongue of said slider being operable to open and close a hook opening of said hook and advance farther than the hook, an end of the tongue being laterally opened by the hook when the tongue advances farther than the hook so that the tongue protrudes above the needle bed gap in a condition wherein a stitch loop held on the compound needle is placed on the tongue;

(ii) needle operation means including needle body operation means and slider operation means provided on a carriage for controlling the needle body and the slider to be advanced and retracted for knitting stitch loops;

(iii) needle body and slider operating holding cams for advancing the hook and the tongue of the compound needle into a stitch loop to be held and for holding the stitch loop at the tongue of the slider; and (iv) a slider butt path for holding the tongue at an advanced position to prevent the held loop from escaping from the tongue, so that a knitted stitched loop may be held to the tongue of the slider of another needle without forming a double stitch.

2. A stitch loop holding apparatus for a flat knitting machine as claimed in claim 1, wherein said needle body and slider operating holding cams are provided on a carriage separately form said needle operation means, and said stitch loop holding apparatus further comprises a slider butt path for holding the tongue at an advanced position to prevent the held loop from escaping from the tongue, so that a knitted stitch loop may be held to the tongue of a slider of another needle without forming a double stitch.

3. A stitch loop holding apparatus for a flat knitting machine as claimed in claim 1, wherein said slider operation means is provided integrally with said needle operation means for said stitch loops so that a loop is directly held on a needle of an opposing bed.

4. A stitch loop holding apparatus for a flat knitting machine as claimed in claim 3, wherein said needle body operation means comprises:

(i) a raising cam including a pair of mountains disposed in a juxtaposed relationship on the left and right, each of said mountains comprising a peripheral edge serving as a pair of butt raising faces, a low top portion, a high top portion higher than the low top portion, and a needle transfer cam provided between said pair of mountains, said raising cam having a pair of crossing paths provided at base portions of said pair of left and right mountains such that said crossing paths are communicated at central portions thereof with butt guide grooves of the peripheries of said left and right, high and low mountains, (ii) a pair of knitting cams on the opposite sides of said raising cam, and (iii) a guard cam above said raising cam, and wherein said slider operation means comprises:

(i) a delivery slider advancing cam having a delivery slider raising groove formed therein, (ii) a reception slider holding cam which forms a receiver slider raising groove, and (iii) a slider transfer cam provided on a same center line as a center line of said raising cam of said needle body operation means, said delivery slider advancing cam and said reception slider holding cam being provided laterally with respect to said center line of said slider transfer cam and said receiving cam, said slider transfer cam having a slider butt path provided therein for holding the tongue at an advanced position so that the loop held on the tongue may not escape from the tongue.

* * * * *